US008443754B2

(12) United States Patent
Yamada

(10) Patent No.: US 8,443,754 B2
(45) Date of Patent: May 21, 2013

(54) ELECTROSTATIC COATING APPARATUS

(75) Inventor: Yukio Yamada, Fujieda (JP)

(73) Assignee: ABB K.K., Tokyo (JP)

( * ) Notice: Subject to any disclaimer, the term of this patent is extended or adjusted under 35 U.S.C. 154(b) by 393 days.

(21) Appl. No.: 12/676,460

(22) PCT Filed: Oct. 9, 2008

(86) PCT No.: PCT/JP2008/068808
§ 371 (c)(1),
(2), (4) Date: Mar. 4, 2010

(87) PCT Pub. No.: WO2009/069396
PCT Pub. Date: Jun. 4, 2009

(65) Prior Publication Data

US 2010/0206225 A1 Aug. 19, 2010

(30) Foreign Application Priority Data

Nov. 30, 2007 (JP) ..... 2007-310644

(51) Int. Cl.
*B05B 5/025* (2006.01)
*B05B 3/00* (2006.01)

(52) U.S. Cl.
USPC ..... 118/629; 118/628; 118/625; 118/323; 239/703; 239/706

(58) Field of Classification Search
USPC ..... 118/620–640, 321, 323; 239/223, 239/224, 699–708; 427/475, 477, 485, 486
See application file for complete search history.

(56) References Cited

U.S. PATENT DOCUMENTS

| | | | | |
|---|---|---|---|---|
| 5,928,731 | A * | 7/1999 | Yanagida et al. | 427/475 |
| 6,896,735 | B2 | 5/2005 | Giuliano | |
| 7,546,962 | B2 | 6/2009 | Yamada | |
| 7,661,610 | B2 | 2/2010 | Yamada | |
| 2001/0032897 | A1 * | 10/2001 | Iwata et al. | 239/690 |
| 2008/0178802 | A1 * | 7/2008 | Sakakibara et al. | 118/621 |

FOREIGN PATENT DOCUMENTS

| | | |
|---|---|---|
| JP | 4 215864 | 8/1992 |
| JP | 6 7709 | 1/1994 |
| JP | 2001 96201 | 4/2001 |
| JP | 2003 144985 | 5/2003 |

OTHER PUBLICATIONS

U.S. Appl. No. 13/145,949, filed Jul. 22, 2011, Yamada.

* cited by examiner

*Primary Examiner* — Yewebdar Tadesse
(74) *Attorney, Agent, or Firm* — Oblon, Spivak, McClelland, Maier & Neustadt, L.L.P.

(57) ABSTRACT

An atomizer (2) with a rotary atomizing head (4) is mounted on the front side of a housing member (6) in which an air motor (3) is accommodated. A primary external electrode (8) is located around the outer peripheral side of the housing member (6) in such a way as to encircle the housing member (6). A secondary external electrode (10) is located on the front side of the housing member (6), in a position closer to the rotary atomizing head (4) than the primary external electrode (8). A first high voltage (V1) in the form of a direct-current voltage is supplied to the primary external electrode (8) from a first high voltage generator (11). On the other hand, a second high voltage (V2), in the form of a pulsating voltage (V2*p*) consisting of a series of intermittent pulses in a range lower than the first high voltage (V1), is supplied to the secondary external electrode (10) from a second high voltage generator (12).

12 Claims, 19 Drawing Sheets

ELECTROSTATIC COATING APPARATUS

TECHNICAL FIELD

This invention relates to an electrostatic coating apparatus which is adapted to spray paint under application of a high voltage.

BACKGROUND ART

Recently, from the standpoint of global environmentalism, there is a positive trend in industrial painting toward the use of aqueous paint in place of solvent type paint to reduce discharges of organic solvents. Aqueous paint is a conducting paint which is low in electrical resistance, so that an aqueous paint coating apparatus should be constructed in such a way as to prevent leakage of high voltage currents toward a paint supply source on the grounded side through a paint supply passage. As a measure for preventing leaks of high voltage currents (as a voltage block means), it has been known in the art to provide a plural number of external electrodes on the outer peripheral side of a rotary atomizing head, thereby discharging a high voltage to indirectly electrify paint particles which are sprayed forward from the rotary atomizing head (see, for example, Patent Literature 1: Japanese Patent Laid-Open No. H4-215864, Patent Literature 2: Japanese Laid-Open No. H6-7709, and Patent Literature 3: U.S. Pat. No. 6,896,735).

In Patent Literature 1 mentioned above, a shielding projection of insulating material is provided on the front side of each external electrode in the proximity of a rotary atomizing head to prevent short-circuiting of a high voltage between an external electrode and rotary atomizing head. This arrangement is effective for preventing short-circuiting between an external electrode and rotary atomizing head by existence of the shield projection. However, due to the existence of shielding projections as obstacles in the way of sprayed paint particles, there is a tendency that an ionizing zone which imparts electric charges to paint particles is formed at a remote position from the rotary atomizing head so that it is difficult to electrify sprayed paint particles to a sufficient degree.

Further, disclosed in Patent Literature 2 is an electrostatic coating apparatus which is equipped with a plural number of external electrodes in a ring-like formation on the outer peripheral side of a rotary atomizing head thereby to impart electric charges to paint particles, along with an annular auxiliary electrode which is disposed to circumvent the outer peripheral side of a plural number of the external electrodes. In this case, as compared with the external electrodes, a higher voltage is applied to the auxiliary electrode thereby to enhance the strength of an electric field between the auxiliary electrode and a coating object for prevention of backward drifting of paint particles. However, since the external electrodes are located in the proximity of a rotary atomizing head, there are tendencies toward frequent short-circuiting between an external electrode and the rotary atomizing head. In order to prevent short-circuiting between an external electrode and the rotary atomizing head, it becomes necessary to apply a lower voltage to the external electrodes despite a difficulty of charging paint particles to a satisfactory degree.

Further, disclosed in Patent Literature 3 above are a plural number of external electrodes which are fitted in a housing of a coating apparatus in a ring-like formation. In this case, fore ends of the external electrodes are located in close proximity of the housing, so that electrification of the housing takes place only in the ambience of fore distal ends of the external electrodes when a high voltage is discharged from fore distal ends of the external electrodes. Thus, this coating apparatus has a problem that charged paint particles on the float tend to deposit on the housing.

DISCLOSURE OF THE INVENTION

In view of the above-discussed problems with the prior art, it is an object of the present invention to provide an electrostatic coating apparatus which is capable of electrifying paint particles to a sufficient degree by discharging a high voltage at positions in the proximity of a rotary atomizing head, while preventing deposition of paint particles on outer surfaces of a housing member.

(1) In order to solve the above-discussed problems, the invention is applied to an electrostatic coating apparatus which is comprised of a paint spraying means having a rotary atomizing head on the front end side thereof and spraying a paint which is supplied to the rotary atomizing head toward a coating object, a housing member formed of an insulating material and adapted to hold the paint spraying means at the front side thereof, a primary external electrode located on the outer peripheral side of the housing member, a secondary external electrode located closer to the rotary atomizing head than the primary external electrode, a first high voltage application means adapted to apply a first high voltage to the primary external electrode, and a second high voltage application means adapted to apply a second high voltage to the secondary external electrode.

The configuration adopted by the present invention is characterized in that the second high voltage application means is adapted to generate a pulsating voltage whose voltage varies intermittently in a range lower than the first high voltage and to apply the second high voltage consisting of the pulsating voltage to the secondary external electrode.

With the arrangements just described, the secondary external electrode is located in a position closer to the rotary atomizing head than the primary external electrode. Thus, the secondary external electrode can serve as a paint particle charging electrode for electrifying individual paint particles which are sprayed forward by the rotary atomizing head.

In this connection, when a direct-current voltage is applied to the secondary external electrode, a stronger corona discharge is likely to occur at a certain point in a conglutinated (concentrated) fashion. As a reason for this, it is considered that a further drop in apparent insulation resistance occur in a certain locality due to ionization caused by conduction of a current as a result of the discharge. Under these circumstances, it is very likely for a streamer to develop around one electrode in that locality. That is to say, in case of a plural number of secondary external electrodes are located around a rotary atomizing head when a corona discharge occurs at one of the secondary external electrodes, a drop in insulation resistance takes place more conspicuously around one electrode member in corona discharge, as compared with the insulation resistance around other electrode members. The concentrated corona discharge at one electrode member can lead to development of a streamer and eventually a spark.

In contrast according to the present invention, a pulsating voltage consisting of a series of intermittent pulses is applied to the secondary external electrode as a second high voltage. Therefore, a strong corona is produced on the secondary external electrode intermittently in such a way as to constantly preclude the possibilities of emergence of a streamer, namely, a precursor phenomenon which will bring about a spark as a result of concentration of an electric discharge. Accordingly, when a pulsating voltage is applied, the voltage can be dropped before occurrence or development of a streamer. This means that it becomes feasible to apply a higher voltage as compared with a non-pulsating direct-current voltage. Thus, it becomes possible to impart more electric charges to paint particles which are sprayed by the rotary atomizing head, for the purpose of attaining higher paint deposition efficiency.

On the other hand, as compared with the secondary external electrode, it feasible to apply a higher voltage to the primary external electrode which is located in a more distant position from the rotary atomizing head than the secondary external electrode. Thus, the primary external electrode can be applied as an electric field-forming electrode thereby to form a strong electric field between the primary external electrode and a coating object. By a corona discharge which is produced on the primary external electrode by the first high voltage, the outer surfaces of the housing member are electrified with a high voltage by supply of discharge ions. Furthermore, floating paint particles in the environs of the primary external electrode can be re-electrified by the corona discharge.

Further, the secondary external electrode is provided for electrification of paint particles, the primary external electrode can be located in a sufficiently distant position from the rotary atomizing head to prevent occurrence of short-circuiting therebetween. Therefore, the primary external electrode can afford a high degree of freedom in design.

(2) According to the present invention, the secondary high voltage application means is adapted to set a width of the pulsating voltage at a shorter time than a streamer emergence time over which a streamer comes to emerge as a result of an increase of electronic avalanches and to set an interval between the pulsating voltages at a longer time than a refresh time over which a weak and stable corona discharge comes to emerge around the secondary external electrode as a result of a decrease of positive ions.

In this instance, the term "electronic avalanche" refers to a phenomenon of electrons in existence in the environs of the external electrode being accelerated under the influence of a strong electric field which is formed around the external electrode, propagating flocks of electrons by repeated impact ionizations in the course of a travel toward a coating object. The term "streamer" refers to a precursor phenomenon to a spark, which is caused by concentration of discharge at one spot.

With the arrangements described above, the width of pulses in the pulsating voltage which is applied from the second high voltage application means is set in a shorter time length as compared a streamer emergence time over which a streamer comes to emerge as a result of an increase of electronic avalanches. Therefore, even if the electronic avalanche is increased by application of the pulsating voltage to the secondary external electrode, the voltage is dropped before emergence of a streamer to preclude the possibilities of occurrence of a spark.

In addition, the intervals between adjacent pulses in the pulsating voltage from the second high voltage application means is set in a longer time length as compared with a refresh time over which a weak and stable corona discharge is brought on around the secondary external electrode as a result of a decrease of positive ions. Therefore, when the pulsating voltage is applied to the secondary external electrode, a state of high insulation resistance is created around the secondary external electrode.

Accordingly, even if the electronic avalanche is increased by application of a pulsating voltage to the secondary external electrode, a state before the increase of electronic avalanche around the secondary external electrode, i.e., a state of a weak continuous corona discharge can be restored until a next pulse is applied, to prevent development of a streamer in an assured manner.

(3) In a preferred form of the present invention, the secondary external electrode is constituted by an acicular electrode member having a fore distal end thereof located around circumference of the rotary atomizing head.

In this case, an electric field can be concentrated at a fore distal end of each acicular electrode member to accelerate a corona discharge. In addition, since the secondary external electrode is applied with a pulsating voltage consisting of a series of intermittent pulses from the second high voltage application means, all of the acicular electrode members of the secondary external electrode are uniformly put in corona discharge, free of concentration of a corona discharge on one acicular electrode member even when a plural number of acicular electrode members are provided.

(4) In another preferred form of the present invention, the secondary external electrode is constituted by a ring electrode member located in such a way as to encircle the outer peripheral side of the rotary atomizing head.

In this case, a corona discharge can be brought on uniformly all around the ring electrode member. In addition, since the second high voltage application means is adapted to apply to the secondary external electrode a pulsating voltage consisting of a series of intermittent pulses, a corona discharge can be brought on uniformly all around the ring electrode member, free of concentration of a corona discharge at one spot.

(5) According to the present invention, the ring electrode member is formed of a semiconducting material or a conducting material whose surface is coated with an insulating material.

Generally, as compared with an acicular electrode member, a ring electrode member is large in electrostatic capacity to earth. Therefore, when sparks come out upon approaching abnormally close proximity to a grounded object like the coating object, there is a tendency toward conduction of a larger discharge current to increase the possibilities of firing. However, in case a ring electrode member is formed of a semiconducting material as in the present invention, the discharge current can be minimized to a suitable degree. Further, when a ring electrode member is formed of a conducting material with an insulating surface coating as in the present invention, occurrence of a spark can be prevented by the insulating surface coating.

(6) In another preferred form of the invention, the primary external electrode is constituted by an acicular electrode member having a fore distal end thereof located at a more distant position from the rotary atomizing head than the secondary external electrode.

In this case, an electric field can be concentrated at the fore distal end of each acicular electrode member of the primary external electrodes to form a strong electrostatic field between the acicular electrode member and a coating object. By way of this strong electrostatic field, charged paint particles resulting from electrification by the primary and secondary external electrodes can be urged to fly toward the coating object in a more positive fashion.

(7) In another preferred form of the invention, the primary external electrode is constituted by a ring electrode located member in such a way as to encircle the outer peripheral side of the housing member at a more distant position from the rotary atomizing head than the secondary external electrode.

In this case, a corona discharge can be generated all around the ring electrode member of the primary external electrode. Thus, a sufficient amount of discharge ions can be supplied to the housing member for maintaining the outer surfaces of the housing member at a high potential in a stabilized state. Further, paint particles which have been attenuated in electrification level can be re-electrified by the corona discharge occurring on the ring electrode member.

(8) In still another preferred form of the invention, the primary external electrode is constituted by a bladed electrode member adapted to encircle the outer peripheral side of the housing member in a more distant position from the rotary atomizing head than the secondary external electrode, and provided with edge sections in the form of a thin blade around an outer end of a blade ring.

In this case, an electric field can be concentrated at each one of the edge sections of the bladed electrode member which forms the primary external electrodes, bringing about corona discharges all around the bladed electrode member. Therefore, a sufficient amount of discharge ions can be supplied to the housing member to maintain outer surfaces of the latter at a high potential in a stabilized state. Besides, paint particles which have been attenuated in electrification level can be re-electrified by the corona discharges at the edge sections of the bladed electrode member.

Furthermore, by way of the edge sections of the bladed electrode member, corona discharges can be brought about all around the annular bladed electrode member which is located in such a way as to circumvent the housing member. Therefore, as compared with a case where a corona discharge is brought about only in part of a bladed electrode, it becomes possible to downsize the bladed electrode member to a significant degree to keep a sufficient distance between the bladed electrode member and a coating object. As a consequence, it becomes possible to prevent occurrence of a spark between the bladed electrode member and a coating object, and to improve maneuverability of the coating apparatus by broadening a movable range of a paint spraying means even when in a coating operation in a narrow limited space.

(9) According to the present invention, the edge sections of the bladed electrode member are provided with a plural number of notches at intervals around the entire periphery thereof.

With the arrangements just described, an electric field can be concentrated at opposite ends of adjoining the notches in the circumferential direction. Thus, discharges take place more readily at opposite ends of the respective notches in the circumferential direction to accelerate corona discharges on the bladed electrode member.

(10) According to another preferred form of the invention, the primary external electrode is constituted by a helical electrode member formed by helically winding a wire and located in such a way as to encircle the outer peripheral side of the housing member at a more distant position from the rotary atomizing head than the secondary external electrode.

In this case, the helical electrode member of the primary external electrode can be downsized in external shape despite use of a wire which is increased in total length. Besides, by employing a wire of a smaller diameter, concentration of electric field can be enhanced in every part of the helical electrode member to continue the corona discharge. Thus, a corona discharge can be brought about on the entire helical electrode member which is very large in total length. That is to say, the helical electrode member is capable of producing an increased amount of discharge ions to supply a sufficient amount of discharge ions to the housing member.

Furthermore, the helical electrode member is capable of producing a corona discharge in every part of the electrode, so that the helical electrode member can be downsized to a more compact form as compared with an arrangement to produce a corona discharge only on a limited part of an electrode member. That is to say, the helical electrode member can always be kept at a sufficient distance from a coating object, precluding occurrence of sparking between the helical electrode member and the coating object and at the time improving maneuverability of the coating apparatus by broadening a movable range of a paint atomizing means even in an operation in a narrow space.

(11) According to the present invention, the first high voltage application means is adapted to generate a pulsating voltage whose voltage varies intermittently and to apply the first high voltage consisting of the pulsating voltage to the primary external electrode.

In this case, as a first high voltage, the first high voltage application means is adapted to apply to the primary external electrode a pulsating voltage consisting of a series of intermittent pulses in a place of a direct-current voltage. Thus, a higher voltage can be applied to the primary external electrode to supply an increased amount of discharge ions to outer surfaces of the housing member while re-electrifying floating paint particles with higher electric charges.

(12) According to the present invention, the rotary atomizing head is formed of an insulating synthetic resin material, semiconducting synthetic resin material or insulating synthetic resin material covered with a semiconducting surface coating.

In this case, the rotary atomizing head can suppress occurrence of a spark by the high voltage between the secondary external electrode and the rotary atomizing head effectively as compared with a rotary atomizing head which is formed of a conducting material. This is reflected by a higher degree of freedom in setting the second high voltage for the secondary external electrode and in designing the secondary external electrode, particularly in determining the position and dimensions of the secondary external electrode from the standpoint of downsizing the coating apparatus as a whole to improve its maneuverability in coating operations.

DESCRIPTION OF REFERENCE NUMERALS

Figure 1:
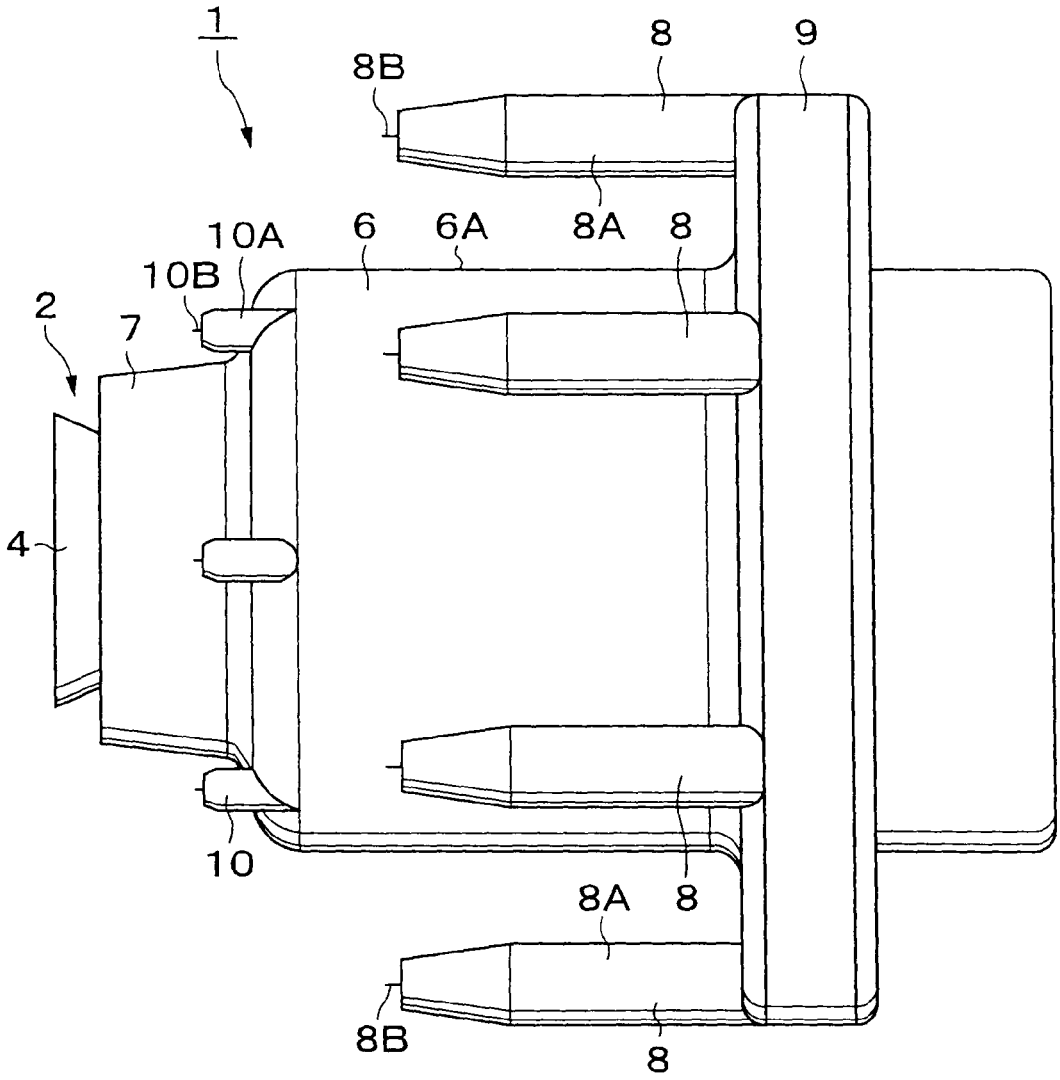
FIG. 1 is a front view of a rotary atomizing head type coating apparatus according to a first embodiment of the invention.

1, 21, 31, 41, 51, 61, 71, 81: Rotary atomizing head type coating apparatus (electrostatic coating apparatus)
2: Atomizer (paint spraying means)
3: Air motor
3C: Rotational shaft
4, 52: Rotary atomizing head
6: Housing member
6A: Outer surface
7: Shaping air ring
8, 22, 62, 72, 82: Primary external electrode
8B, 10B: Acicular electrode member
10, 23, 23', 32: Secondary external electrode
11, 42: First high voltage generator (first high voltage application means)
12: Second high voltage generator (second high voltage application means)
22B, 23B, 23B', 32B: Ring electrode member
24: Metal wire
25: Insulating surface coating
63, 73: Bladed electrode member
64-66, 74-76: Edge section
77-79: Notch
83: Helical electrode member

BEST MODE FOR CARRYING OUT THE INVENTION

Hereafter, with reference to the accompanying drawings, the present invention of the electrostatic coating apparatus is described more particularly by way of its preferred embodiments which are applied by way of example to a rotary atomizing head type coating apparatus.

Referring first to FIGS. 1 through 6, there is shown an electrostatic coating apparatus according to a first embodiment of the present invention.

In these figures, indicated at 1 is a rotary atomizing head type coating apparatus according to the first embodiment, the coating apparatus 1 being constituted by an atomizer 2, a housing member 6, primary and secondary external electrodes 8 and 10, and first and second high voltage generators 11 and 12, which will be described hereinafter.

Indicated at 2 is an atomizer as a paint spraying means for atomizing and spraying paint toward a coating object A which is held at the earth potential. The atomizer 2 is constituted by an air motor 3 and a rotary atomizing head 4, which will be described hereinafter.

Figure 2:
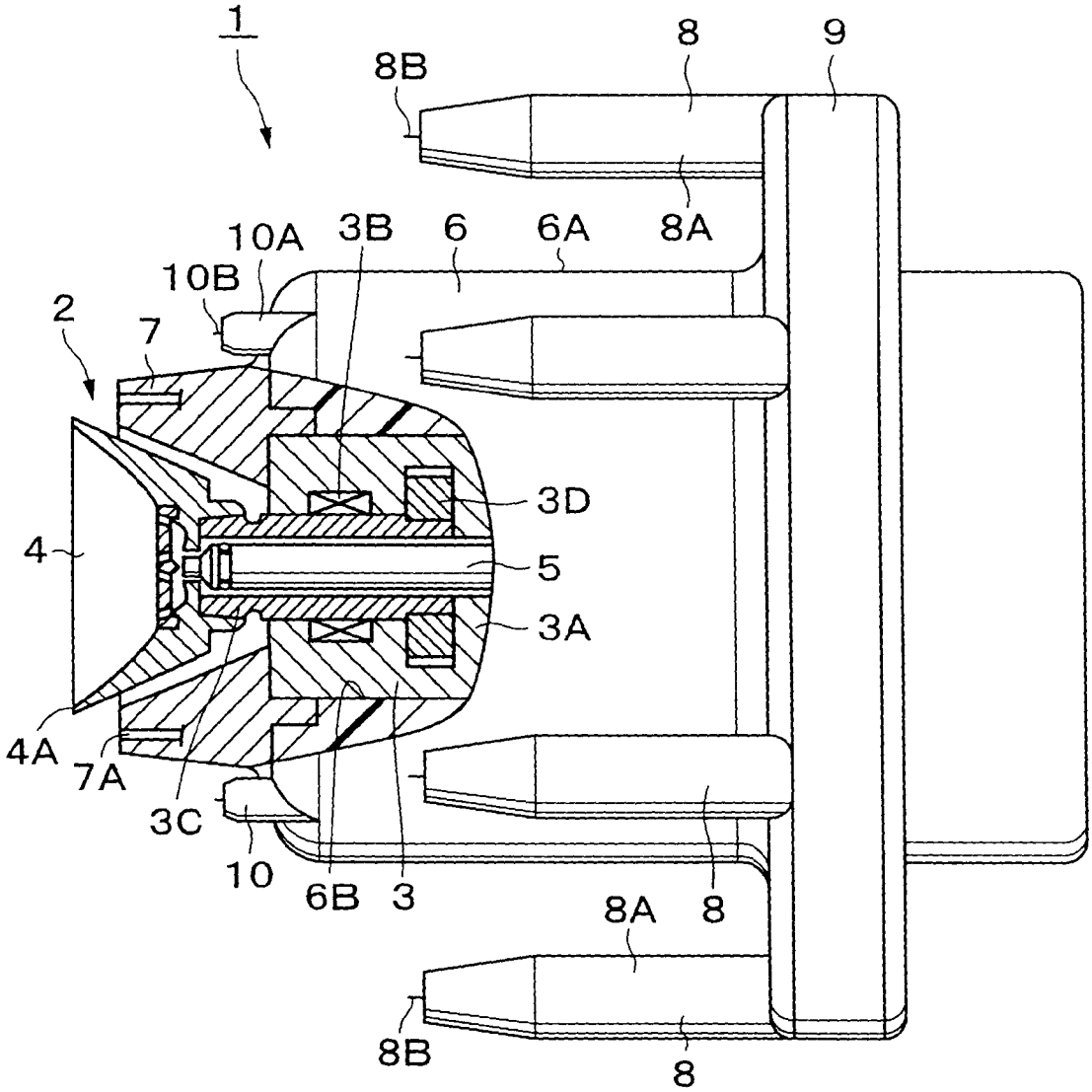
FIG. 2 is a front view of the rotary atomizing head type coating apparatus of FIG. 1, cutting away a circumferential portion of an atomizer.

Indicated at 3 is an air motor which is formed of a conducting metallic material. As shown in FIG. 2, the air motor 3 is constituted by a motor housing 3A, a hollow rotational shaft 3C which is rotatably supported within the motor housing 3A through a static air bearing 3B, and an air turbine 3D which is fixed on a base end of the rotational shaft 3C. By supplying driving air to the air turbine 3D of the air motor 3, the rotational shaft 3C and rotary atomizing head 4 are put in high speed rotation, for example, at a speed of 3,000 to 100,000 rpm.

Denoted at 4 is a rotary atomizing head which is mounted on a fore distal end portion of the rotational shaft 3C of the air motor 3. This rotary atomizing head 4 is made of a conducting metallic material, for example, an aluminum alloy or the like. In operation, the rotary atomizing head 4 is put in high speed rotation by the air motor 3. In this state, the rotary atomizing head 4 is supplied with paint through a feed tube 5, which will be described hereinafter, and the rotary atomizing head 4 sprays the paint from paint releasing edges 4A at its fore distal end portion under the influence of centrifugal force. The rotary atomizing head 4 receives a supply of aqueous paint from a paint supply source (not shown) which is held, for example, at the earth potential, so that the rotary atomizing head 4 itself is also at the earth potential.

Indicated at 5 is a feed tube which is passed through the hollow rotational shaft 3C. A fore end portion of the feed tube 5 is projected out of the fore end of the rotational shaft 3C and extended into the rotary atomizing head 4. Provided internally of the feed tube 5 is a paint passage (not shown) which is connected to a paint supply source and a wash thinner supply source (both not shown) via a color changing valve system. Thus, the feed tube 5 plays a role of supplying paint from the paint supply source to the rotary atomizing head 4 through the paint passage during a coating operation, and a role of supplying a wash fluid (thinner, air and so forth) from the wash thinner supply source at the time of a cleaning operation or at the time of color change.

Designated at 6 is a housing member which is adapted to accommodate the air motor 3 on the rear side of the rotary atomizing head 4. For example, this housing member 6 is formed substantially in a cylindrical shape by the use of an insulating synthetic resin material. Further, the housing member 6 is formed with a cylindrical outer surface 6A, and provided with a motor casing bore 6B in its front side to accommodate the air motor 3.

The entire housing member 6 may be formed by the use of one and same material or alternatively by the use of different materials, for example, in forming internal structures and outer surface 6A. In this case, for the purpose of preventing deposition of paint particles, it is desirable to form the outer surface 6A of the housing member 6 by the use of an insulating synthetic resin material having high insulation properties along with non-hydrophilic properties, for example, PTFE (polytetrafluoroethylene), POM (polyoxymethylene) or PET (polyethylene terephthalate) with a treated surface for water repellency and the like.

Indicated at 7 is a shaping air ring for spurting shaping air. This shaping air ring 7 is attached on the fore distal end (on the front end) of the housing member 6 in such a way as to circumvent the outer peripheral side of the rotary atomizing head 4. The shaping air ring 7 is formed in an annular shape by the use of substantially the same material as the housing member 6. A plurality of air outlet holes 7A are bored in the shaping air ring 7, and the air outlet holes 7A are in communication with a shaping air supply passage (not shown) which is provided internally of the housing member 6. Thus, shaping air which is supplied through the shaping air passage is spurted out through the air outlet holes 7A for adjusting a spray pattern of paint particles which are released from the rotary atomizing head 4.

Figure 3:
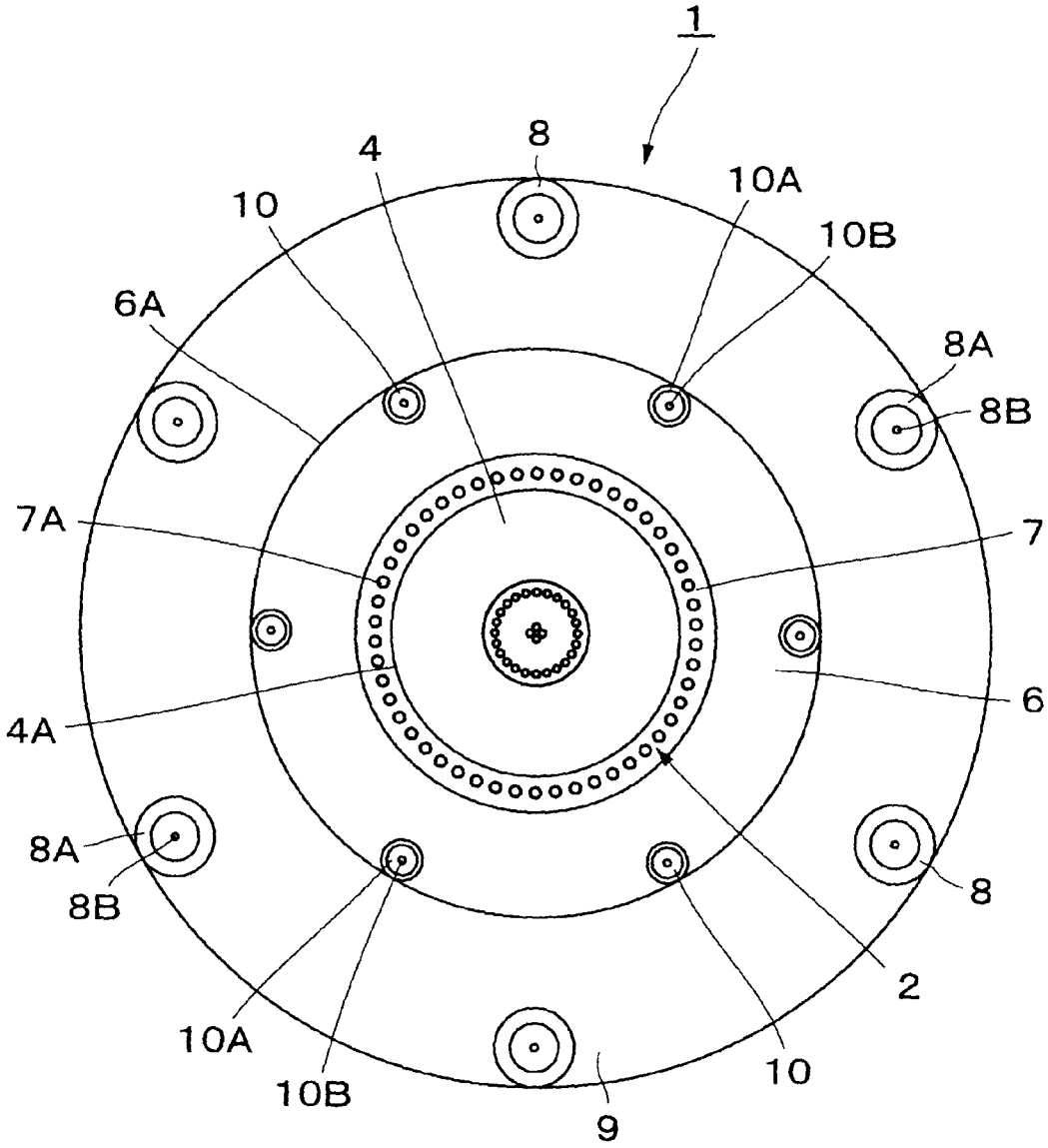
FIG. 3 is a left-hand side view of the rotary atomizing head type coating apparatus of the first embodiment in FIG. 1.

Indicated at 8 is a primary external electrode which is located around the outer peripheral side of the housing member 6. As shown in FIGS. 1 through 3, the primary external electrode 8 is fixedly mounted on an annular support member 9 which is in turn mounted on a rear portion of the housing member 6. In this instance, the support member 9 is formed of, for example, the same insulating synthetic resin material as the housing member 6 and projected radially outward of the housing member 6. Further, for example, six external electrodes 8 are located in uniformly spaced circumferential positions around the projected outer end side (the outer diameter side) of the support member 9.

Each one of the primary external electrodes 8 is constituted by a long rod-like electrode support arm 8A which is extended forward on the front side of the support member 9, and an acicular electrode member 8B which is provided at the fore distal end of the electrode support arm 8A. In this instance, each electrode support arm 8A is formed of, for example, the same insulating synthetic resin material as the housing member 6, and its fore distal end is located on the outer peripheral side of the rotary atomizing head 4. On the other hand, each acicular electrode member 8B is formed in an acicular shape having a free end on the front side, by the use of a conducting material, for example, by the use of a metallic material, and connected to a first high voltage generator 11 through a resistor 8C which will be described hereinafter. In this instance, the resistor 8C serves to suppress a sudden and abrupt discharge of accumulated electric charge from the side of the first high voltage to generator 11 in the event of an occurrence of short-circuiting between an acicular electrode member 8B and a coating object A. From the first high voltage generator 11, a first high voltage V1 is applied to each one of the acicular electrode members 8B.

The above-mentioned six acicular electrode members 8B are located in a circular row concentrically around the rotary atomizing head 4 and in radial positions coinciding with a circle of a large diameter which is drawn around the rotational shaft 3C at the center. Thus, all of the six acicular electrode members 8B are located at the same distance from the rotary atomizing head 4. Further, the acicular electrode members 8B of the primary external electrodes 8 are spaced from the housing member 6 by a clearance (a space) and are arranged to circumvent the outer peripheral side of the housing member 6. By a corona discharge which is brought on each one of the respective acicular electrode members 8B, paint particles which are afloat around the housing member 6 are re-electrified with a high voltage, and at the same time corona ions are fed to the outer surface 6A of the housing member 6 to electrify the outer surface 6A of the housing member 6.

Indicated at 10 is a secondary external electrode which is located at the front of the housing member 6. For example, six secondary external electrodes 10 are located in uniformly spaced circumferential positions around the front end of the housing member 6. In this instance, each secondary external electrode 10 is located in a position intermediate between two adjacent primary external electrodes 8 in the circumferential direction. Thus, the six secondary external electrodes 10 are located in staggered circumferential positions relative to the six primary external electrodes 8.

Each one of the secondary external electrodes 10 is constituted by an electrode support arm 10A of a short rod-like shape which is projected on the front side of the housing member 6, and an acicular electrode member 10B which is provided at the fore distal end of the electrode support arm 10A. In this instance, for example, the electrode support arm 10A is formed of the same insulating synthetic resin material as the housing member 6, and its fore distal end is located in a position radially outward of the rotary atomizing head 4. On the other hand, the acicular electrode member 10B is formed in an acicular shape and in the fashion of a cantilever, by the use of a conducting material like a metal, for example, and connected to a second high voltage generator 12 through a resistor 10C. In this instance, the resistor 100 serves to suppress sudden and abrupt discharge of accumulated electric charge from the side of the secondary high voltage generator 12 in the event of an occurrence of short-circuiting between an acicular electrode member 10B and a coating object A. A second high voltage V2 is applied to each one of the acicular electrode members 10B from the second high voltage generator 12.

The acicular electrode members 10B of the external electrodes 10 are located in a circular row concentrically around the rotary atomizing head 4 and in radial positions forwardly inward of the acicular electrode members 8B of the primary external electrodes 8. More particularly, the six acicular electrode members 10B are located in radial positions which are at a smaller distance from the rotational shaft 3C as compared with the circularly arranged acicular electrode members 8B. In addition, the six acicular electrode members 10B are located in positions forward of the acicular electrode members 8B of the primary external electrodes 8 and more closely to the rotary atomizing head 4 in the axial direction (forward and backward direction).

Thus, the six acicular electrode members 10B are located in radial positions which are all uniformly spaced from the rotary atomizing head 4 and disposed more closely to the rotary atomizing head 4 than the acicular electrode members 8B of the primary external electrodes 8. By a corona discharge on each one of the acicular electrode members 10B of the external electrodes 10, mainly paint particles which are sprayed from the rotary atomizing head 4 are charged with a high voltage. Further, since the six acicular electrode members 10B are located in positions in the proximity of the rotary atomizing head 4, they can electrify paint particles sufficiently and uniformly with a high voltage around the entire circumference of (360° around) paint releasing edges 4A of the rotary atomizing head 4.

Further, the acicular electrode members 10B of the external electrodes 10 are located in such a way as to circumvent the shaping air ring 7. Thus, corona ions are supplied from the external electrodes 10 to outer surfaces of the shaping air ring 7 to keep the shaping air ring 7 in an electrified state.

Figure 4:
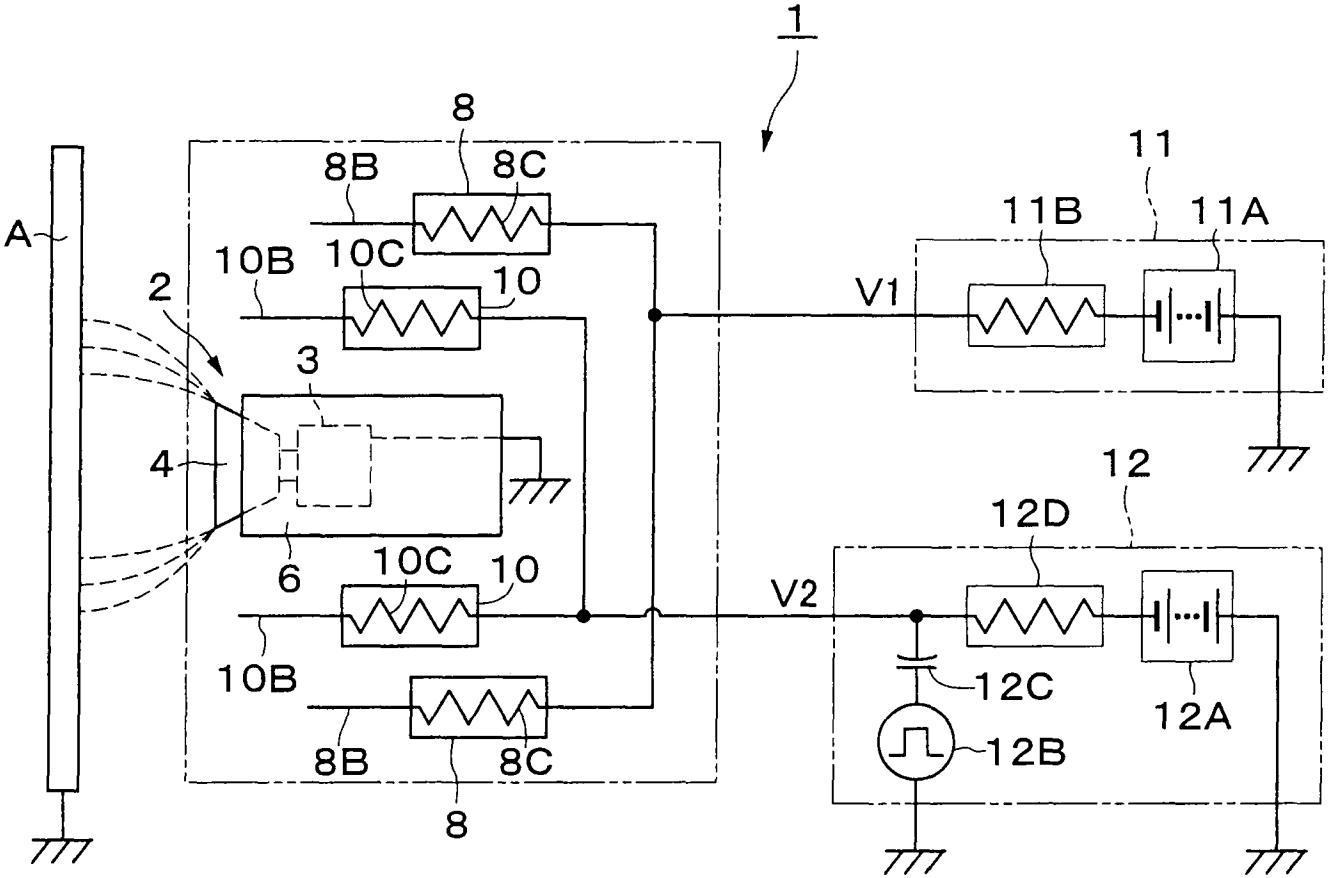
FIG. 4 is a block diagram of a circuitry adopted for the rotary atomizing head type coating apparatus of the first embodiment.

Indicated at 11 is a first high voltage generator which is connected to the primary external electrodes 8 as a first high voltage application means. As shown in FIG. 4, the high voltage generator 11 is comprised of a multi-stage rectification circuit 11A (i.e., the so-called Cockcroft circuit) which is composed of a plurality of condensers and diodes (both not shown). The multi-stage rectification circuit 11A is connected to each one of the acicular electrode members 8B of the external electrodes 8 through a resistor 11B. A first high voltage current V1, for example, a high voltage current with a dc voltage of −60 kV to −100 kV is generated by the high voltage generator 11. Thus, the high voltage generator 11 is applied to the respective acicular electrode members 8B of the external electrodes 8 as a first high voltage V1.

Indicated at 12 is a second high voltage generator which is connected to the respective secondary external electrodes 10 as a second high voltage application means. Similarly to the first high voltage generator 11, the second high voltage generator 12 is comprised of a multi-stage rectification circuit 12A. However, the second high voltage generator 12 is provided with a pulse generator circuit 12B thereby to generate a pulsating high voltage V2*p*. The pulse generator 12B is connected to the output side of the multi-stage rectification circuit 12A through a capacitor 12C and a resistor 12D, and connected to the respective acicular electrodes 10B of the external electrodes 10 at a point between the capacitor 12C and resistor 12D.

Figure 5:
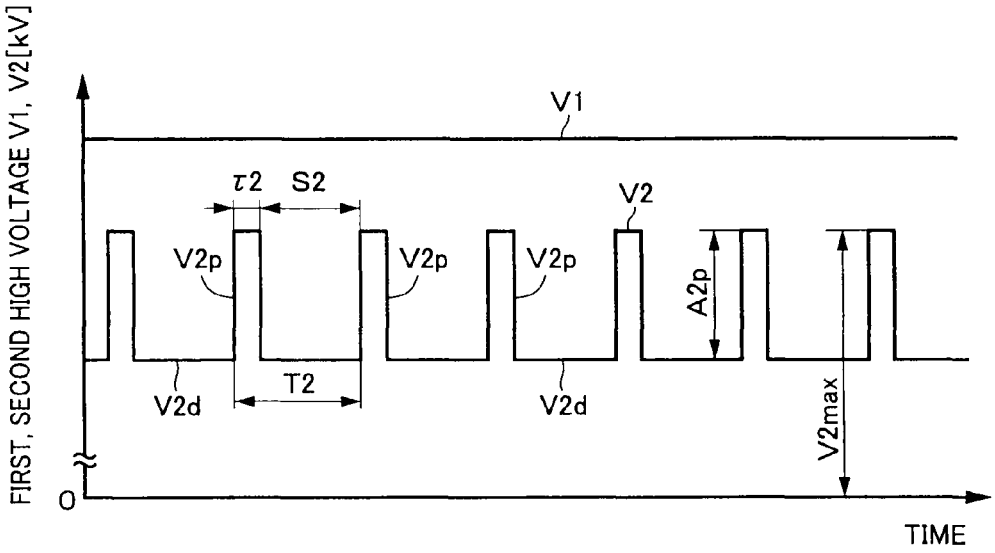
FIG. 5 is a characteristics diagram showing variations with time in first and second high voltages to be applied to primary and secondary external electrodes.
Figure 6:
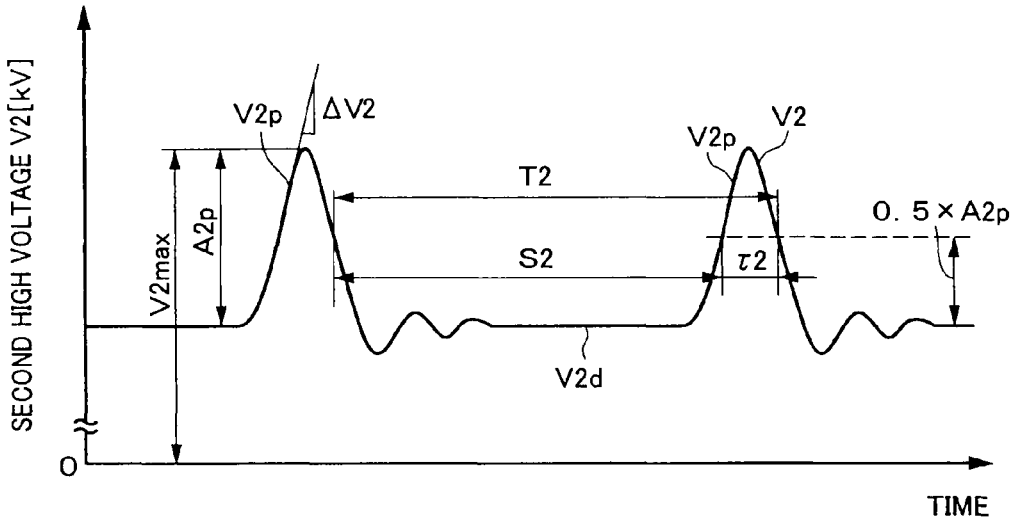
FIG. 6 is a characteristics diagram showing, on an enlarged scale, variations with time in the second high voltage in FIG. 5.
Figure 7:
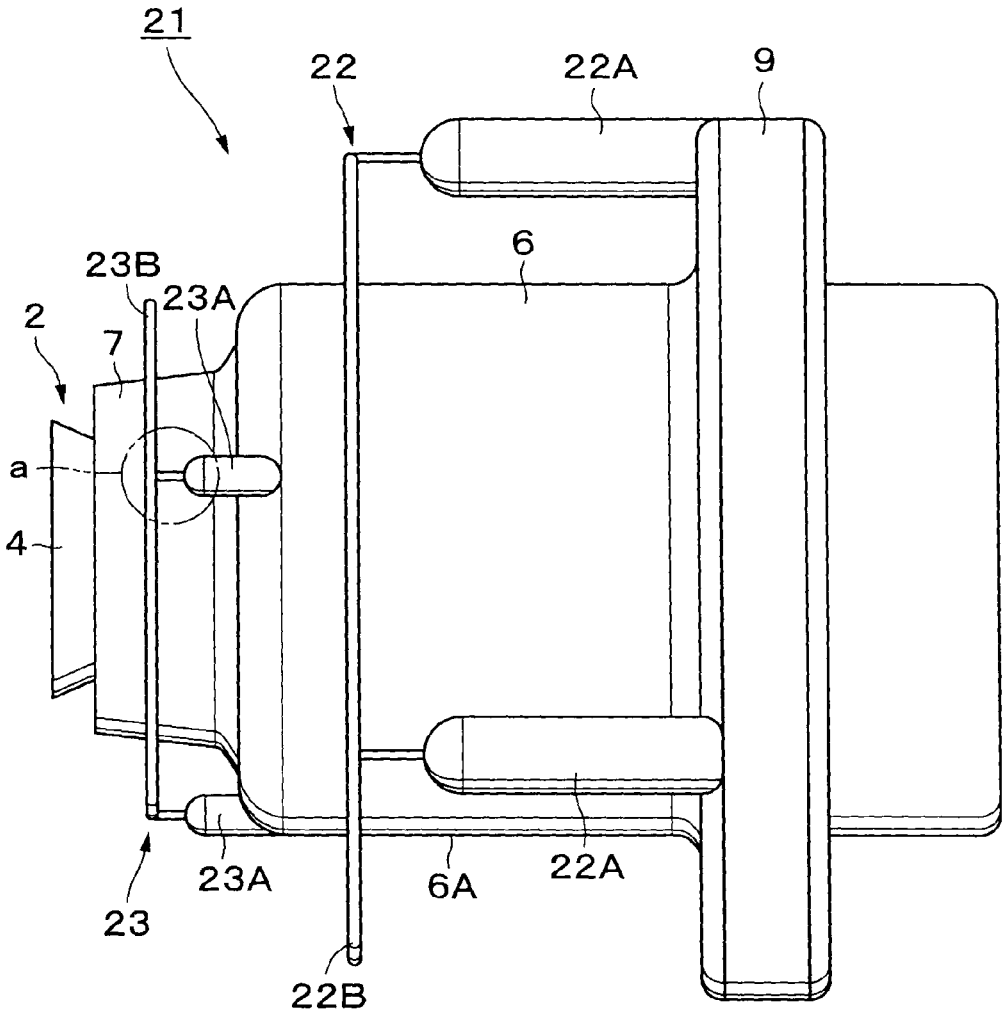
FIG. 7 is a front view of a rotary atomizing head type coating apparatus according to a second embodiment of the invention.
Figure 8:
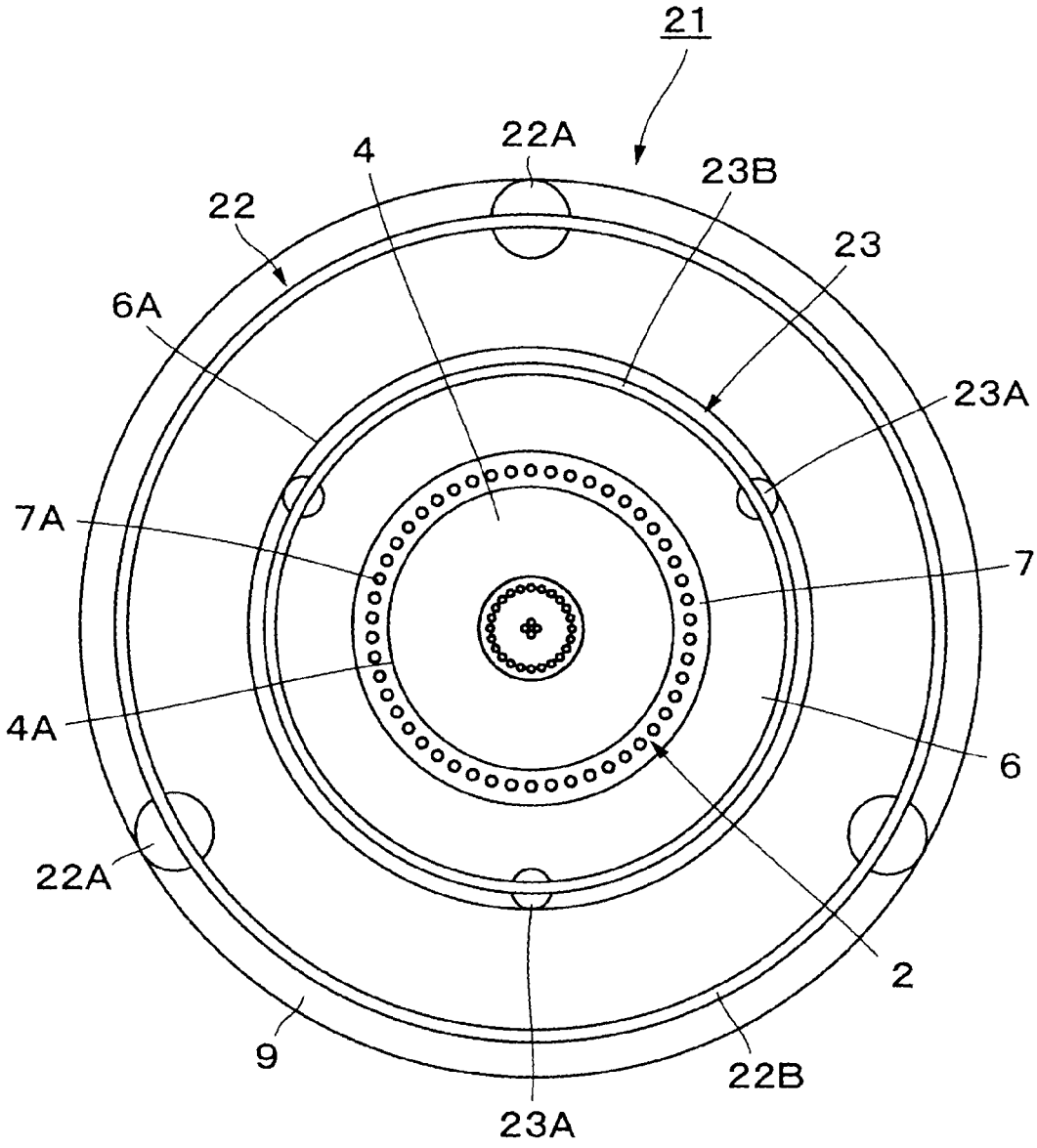
FIG. 8 is a left-hand side view of the rotary atomizing head type coating apparatus of the second embodiment in FIG. 7.
Figure 9:
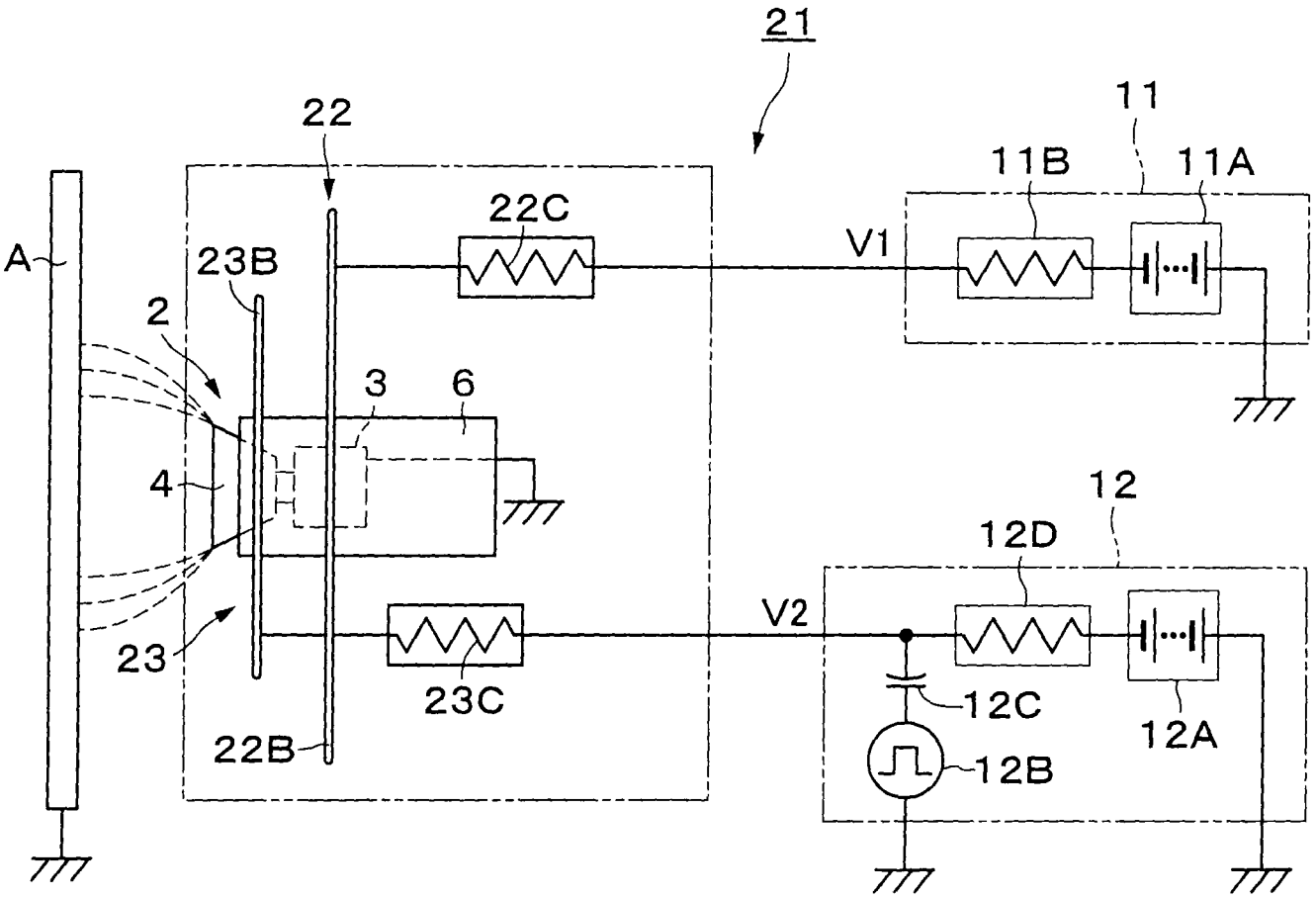
FIG. 9 is a block diagram of a circuitry adopted for the rotary atomizing head type coating apparatus of the second embodiment.
Figure 10:
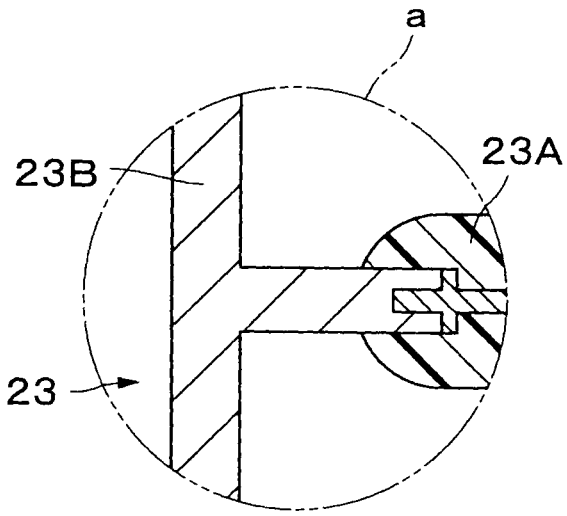
FIG. 10 is a fragmentary sectional view showing, on an enlarged scale, a part of a ring electrode member in the second embodiment, i.e., an encircled part a in FIG. 7.

At the high voltage generator 12, a pulsating voltage V2*p* consisting of a series of intermittent pulses is generated in a lower range as compared with the first high voltage V1, and applied to each one of the acicular electrode members 10B of the external electrode 10 as a second high voltage V2 constituting of the pulsating voltage V2*p*. More particularly, as shown in FIGS. 5 and 6, the second high voltage V2 is composed of a direct-current voltage V2*d*, for example, of −10 kV to −30 kV and a pulsating voltage V2*p* consisting of intermittent pulses, for example, of −10 kV to −45 kV having an amplitude of A2*p*.

In this instance, for example, as expressed by Formula 1 below, the pulse amplitude A2*p* is set at a value which is as large as or smaller than 1.5 times the direct-current voltage V2*d*. The reason for this is to prevent breakdown of the acicular electrode members 10B by constantly applying a negative voltage thereto even when an overshoot takes place at a trailing edge of the pulsating voltage V2*p*.

$$|A2p| \leqq |V2d \times 1.5| \quad \text{[Formula 1]}$$

On the basis of this relationship, a peak voltage V2 max (maximum voltage) of the pulsating voltage V2*p* is set in a lower range (|V2 max|<|V1|) as compared with the first high voltage V1, for example, in a range of −20 kV to −75 kV, as expressed by following Formula 2 below.

$$V2\text{max} = -20 \text{ kV to } -75 \text{ kV}$$

$$|V2\text{max}| < |V1| \quad \text{[Formula 2]}$$

Further, as expressed by Formula 3 below, the pulse width τ2 (a mesial width) of pulses in the pulsating voltage V2*p* is set at a value which is shorter than a streamer emergence time over which a streamer comes to emerge as a result of an increase of electronic avalanches, e.g., at a time duration of 0.5 μs to 5 μs. Here, the term "electronic avalanche" refers to a phenomenon that electrons in the environs of each external electrode 10 are accelerated by a strong electric field which is formed around the external electrodes 10, and subjected to repeated collisional ionizations to form flocks of electrons propagating toward a coating object A. The term "streamer" refers to a precursor phenomenon in which an electric discharge develops to a spark as a result of concentration of discharge at one spot or location.

$$\tau 2 = 0.5 \ \mu s \text{ to } 5 \ \mu s$$

$$\tau 2 < \text{a streamer emergence time} \quad \text{[Formula 3]}$$

Further, as expressed by Formula 4 below, an interval S2 between two adjacent pulses in the pulsating voltage V2*p* is set at a time duration which is longer than a refresh time, e.g., approximately at a value of 0.2 ms to 10 ms. The term. "refresh time" means a time length duration leading to a weak and stable corona discharge occurring around the secondary external electrodes 10 (acicular electrode members 10B) as a result of reductions in number of positive ions.

$$S2 = 0.2 \text{ ms to } 10 \text{ ms}$$

$$S2 > \text{a refresh time} \quad \text{[Formula 4]}$$

Thus, as expressed by Formula 5 below, the pulsating voltage V2*p* has a cyclic period τ2 which is a sum of pulse interval S2 and pulse width τ2. Further, cyclic frequency F2 (F2=1/T2) of the pulsating voltage V2*p* is set, for example, approximately at a value of 100 Hz to 5 kHz. Gradient ΔV2 of the leading edge of the pulsating voltage V2*p* is set, for example, at a value higher than 100 kV/μs so that it will reach a peak voltage V2 max from the direct-current voltage V2*d* within a time which is half as long as the pulse width τ2.

$$T2 = S2 + \tau 2$$

$$F2 = 100 \text{ Hz to } 5 \text{ kHz}$$

$$\Delta V2 \geqq 100 \text{ kV}/\mu s \quad \text{[Formula 5]}$$

The direct-current voltage V2*d* is constantly applied to the respective secondary external electrodes 10 even when the pulsating voltage V2*p* is not applied thereto. Therefore, a weak corona discharge occurs on each one of the secondary external electrodes 10 even when the pulsating voltage V2*p* is not applied thereto. Broader the interval S2 between adjacent pulses in the pulsating voltage V2*p*, the lower becomes the frequency of a strong corona discharge on the respective acicular electrode members 10B, resulting in a lower paint particle electrification efficiency. Therefore, the interval S2 (the cyclic period T2 of the pulsating voltage V2*p*) should preferably be as short as possible within a range where it is longer than the refresh time).

With the above-described arrangements, the rotary atomizing head type coating apparatus 1 of the first embodiment is put in operation in the manner as follows.

After putting the rotary atomizing head 4 of the atomizer 2 in high speed rotation by the air motor 3, paint is supplied to the rotary atomizing head 4 through the feed tube 5. Under the influence of centrifugal force resulting from rotation of the rotary atomizing head 4, paint is atomized into fine particles and sprayed forward as paint particles from the atomizer 2. At the same time, shaping air is spurted out from the shaping air ring 7 to control the spray pattern of paint particles.

The first high voltage V1 in the form of a direct-current voltage is applied to the respective acicular electrode members 8B of the primary external electrodes 8. Thus, an electric field is constantly formed between each acicular electrode member 8B and a coating object A which is at the earth potential. On the other hand, the second high voltage V2, in the form of a pulsating voltage V2*p* consisting of intermittent pulses, is applied to the respective acicular electrode members 10B of the secondary external electrodes 10. As a consequence, a strong corona discharge intermittently occurs on each acicular electrode member 10B, forming ionization zones in the environs of the rotary atomizing head 4. Therefore, paint particles which are sprayed forward by the rotary atomizing head 4 are indirectly charged with a high voltage while flying through an ionization zone. Then, charged paint particles (electrified paint particles) are urged to fly along an electric field which is formed between each acicular electrode member 8B and a coating object A for deposition on the latter.

Thus, in the first embodiment, the secondary external electrodes 10 are located closer to the rotary atomizing head 4 than the primary external electrodes 8 to let the secondary external electrodes 10 function mainly as an electrode for electrification of paint particles sprayed from the rotary atomizing head 4.

In this instance, since the secondary external electrodes 10 are located closer to the rotary atomizing head 4 than the primary external electrodes 8, it is necessary to apply a lower voltage to the secondary external electrodes 10 as compared with the voltage to the primary external electrodes 8 in order to prevent occurrences of sparking between each one of the secondary external electrodes 10 and the grounded rotary atomizing head 4 which is at the earth potential. In case a direct-current voltage is applied to the secondary external electrodes 10, the occurrence of a corona discharge on the secondary external electrodes 10 becomes scarcer correspondingly to reductions of the voltage level to be applied thereto, resulting in a tendency toward degradations in paint particle electrification efficiency.

Besides, it is very likely that a stronger corona discharge occurs at a spot in a certain locality in a conglutinating (concentrated) fashion in case a direct-current voltage is applied to the secondary external electrodes 10. A presumable reason for this is a further drop in apparent insulation resistance in that locality, due to ionization caused by a flow of an electric current resulting from the discharge. As a consequence, a streamer is apt to emerge around an electrode in that locality alone. Therefore, in case a corona discharge occurs to one of the acicular electrode members 10B of the six secondary external electrodes 10, which are located around the circumference of the rotary atomizing head 4, a conspicuous drop in insulation resistance occurs in the environs of that one acicular electrode member 10B in corona discharge as compared with other acicular electrode members 10B. Thus, a corona discharge can occur in a concentrated manner on one and same acicular electrode member 10B, with possibilities of emergence of a streamer which would eventually result in a spark.

In this regard, according to the first embodiment described above, a pulsating voltage V2*p* in the form of a series of intermittent pulses is applied to the respective secondary external electrodes 10 as a second high voltage V2. Therefore, a strong corona is brought about intermittently on each one of the secondary external electrodes 10, constantly preventing concentration of discharges which would lead to development of a streamer and eventually to a spark.

Thus, in a case where the pulsating voltage V2*p* is employed in the manner as in the first embodiment, the voltage is dropped before emergence of a streamer. That is to say, in this case, the peak voltage V2 max of the pulsating voltage V2*p* can be set at a higher level as compared with a direct-current voltage. This means that paint particles which are sprayed from the rotary atomizing head 4 can be imparted with more electric charge in an enhanced manner to improve paint deposition efficiency.

Further, the six secondary external electrodes 10 are so located as to circumvent the rotary atomizing head 4 from a short distance and are each applied with the second high voltage V2 in the form of the pulsating voltage V2*p*. Therefore, corona discharges can be brought about and continued uniformly on the six external electrodes 10 to electrify, uniformly and sufficiently with high voltage, the individual paint particles which are released from around the paint releasing edges 4A of the rotary atomizing head 4. Namely, individual paint particles are constantly and uniformly electrified without producing paint particles which are extremely low in the level of electrification as compared with other paint particles. Accordingly, it becomes possible to prevent floating paint particles from falling outside an electrostatic field and contaminating the housing member 6 by deposition on the outer surface 6A of the latter.

On the other hand, as compared with the secondary external electrodes 10, a higher voltage can be applied to the primary external electrodes 8 which are located at a greater distance from the rotary atomizing head 4. That is to say, the primary external electrodes 8 can be used as an electric field-forming electrode which forms a strong electric field between the coating object A and the primary external electrode 8. Therefore, paint particles, which have been electrified by the secondary external electrodes 10, are urged to fly along an electrostatic field which is formed between each one of the primary external electrodes 8 and a coating object A, and to deposit on the coating object A in an assured manner.

Further, by application of the first high voltage V1, a corona discharge is brought about on each one of the primary external electrodes 8. At this time, the primary external electrodes 8, which are located at a greater distance from the housing member 6, can supply discharge ions to broad areas on the outer surface 6A of the housing member 6. Thus, the outer surface 6A of the housing member 6 can be electrified over a broad range, with electric charge of the same polarity as that of electrified paint particles, causing repulsions between the outer surface 6A and electrified paint particles to prevent paint deposition on the outer surface 6A effectively in an assured manner.

Further, paint particles afloat in the environs of the primary external electrodes 8 can be re-electrified by the corona discharges. Therefore, for example, part of paint particles sprayed from the rotary atomizing head 4 which have failed to undergo electrification by the secondary external electrodes 10 can be re-electrified by the primary external electrodes 8. This contributes to improve paint deposition efficiency by reducing the amount of paint particles which float around the housing member 6 in a barely electrified state.

Further, since paint particles are electrified by the secondary external electrodes 10, the primary external electrodes 8 can be located at a sufficient distance from the rotary atomizing head 4 for prevention of occurrences of short-circuiting therebetween. Thus, the primary external electrodes 8 can enjoy a higher degree of freedom in design.

The primary external electrodes 8 function to form an electrostatic field between the rotary atomizing head 4 and a coating object A, while the secondary external electrodes 10 function to impart electric charges to sprayed paint particles. In order to perform these functions, the primary and secondary external electrodes 8 and 10 are applied with the first and second high voltages V1 and V2, respectively, which can be set with high accuracy to attain a high paint deposition efficiency, which will be reflected by a significant reduction in paint cost.

Further, as expressed by Formula 3 above, the pulse width T2 in the pulsating voltage V2*p*, which is generated by the second high voltage generator 12, is set at a value which is shorter than a streamer emergence time. Therefore, even if electronic avalanches are increased by application of the pulsating voltage V2*p* to the secondary external electrodes 10, the pulsating voltage V2*p* is dropped to a low level before emergence of a streamer to prevent sparking.

The intervals S2 between individual pulses in the pulsating voltage V2*p* applied from the second high voltage generator 12 are set at a longer time length as compared with a refresh time over which a weak stabilized corona discharge is brought about around the secondary external electrodes 10 due to a reduction in number of positive ions. Therefore, for example, even if a number of positive ions around the secondary external electrodes 10 are increased at the time of application of a first pulse in the pulsating voltage V2*p*, positive ions are decreased in number before a time point when a second pulse in the pulsating voltage V2*p* is applied to the secondary external electrodes 10. Thus, when the pulsating voltage V2*p* is applied to the secondary external electrodes 10, a high insulation resistance is maintained around the secondary external electrodes 10.

Therefore, even if electronic avalanches are increased by application of a pulse of the pulsating voltage V2*p* to the secondary external electrodes 10, an initial state before the increase of electronic avalanches (i.e., a state of weak corona discharge) is restored by decreasing positive ions in the environs of the respective secondary external electrodes 10 prior to application of a succeeding pulse in the pulsating voltage V2*p*, to prevent emergence of a streamer in an assured manner.

Besides, the secondary external electrodes 10 are arranged such that fore distal ends of the respective acicular electrode members 10B are located around the circumference of the rotary atomizing head 4 to concentrate an electric field at the fore distal end of each acicular electrode member 10B, accelerating occurrence of a corona discharge. In addition, the pulsating voltage V2*p*, which is intermittently varied in voltage, is applied to the respective secondary external electrodes 10 by the second high voltage generator 12. Therefore, despite provision of a plural number of acicular electrode members 10B, there is no possibility of a corona discharge occurring in a concentrated fashion on one particular acicular electrode member 10B. That is to say, a corona discharge can be uniformly brought about on each one of the acicular electrode members 10B.

Further, the acicular electrode members 8B of the primary external electrodes 8 are arranged in such a way as to concentrate an electric filed at the fore distal end of each acicular electrode member 8B to form a strong electrostatic field between each acicular electrode member 8B and a coating object A. Thus, under the influence of the strong electrostatic field, paint particles, which are imparted with electric charges by the primary and secondary external electrodes 8 and 10, are urged to fly toward the coating object A in a more accelerated manner.

In the first embodiment described above, the shaping air ring 7 is formed of an insulating synthetic resin material. However, the present invention is not limited to this particular example. For instance, the shaping air ring may be formed of a conducting metallic material. In such a case, corona ions are supplied to the shaping air ring of a metallic material from the secondary external electrodes 10 to electrify the entire shaping air ring substantially uniformly in the same polarity as the electrified paint particles. Thus, in this case, the shaping air ring can function as a repulsive electrode to prevent deposition of charged paint particles.

Now, turning to FIGS. 7 through 10, there is shown a rotary atomizing head type coating apparatus according to a second embodiment of the invention.

The second embodiment has a feature in that it employs primary and secondary external electrodes of a ring shape. In the second embodiment, the component elements that are identical to those of the foregoing first embodiment will be simply denoted by the same reference numerals to avoid repetitions of similar explanations.

Indicated at 21 is a rotary atomizing head type coating apparatus of the second embodiment, which is constituted by an atomizer 2, a housing member 6, primary and secondary external electrodes 22 and 23 and first and second high voltage generators 11 and 12, substantially in the same way as the coating apparatus 1 in the foregoing first embodiment.

Indicated at 22 is a primary external electrode which is located around the outer peripheral side of the housing member 6 and the primary external electrode 22 is mounted on an annular support member 9 at the rear of a housing member 6, similarly to the primary external electrode 8 in the first embodiment. However, the primary external electrode 22 of the second embodiment differs from the primary external electrode 8 of the first embodiment in that it is constituted by an electrode member 22B of a ring shape, i.e., a ring electrode member 22B instead of the acicular electrode member 8B.

More particularly, the primary external electrode 22 is constituted by, for example, three long rod-like electrode support arms 22A which are extended forward from the support member 9, and a ring electrode member 22B which is attached on fore distal ends of the electrode support arms 22A. In this instance, the three electrode support arms 22A are each formed of an insulating synthetic resin material, for example, of the same insulating synthetic resin material as the housing member 6, and located in uniformly spaced positions in the circumferential or radial direction. On the other hand, the ring electrode member 22B is formed in the shape of a ring by the use of a semiconducting material, for example, a semiconducting material having approximately a resistance of from 100 MΩ to 300 MΩ, and connected to a first high voltage generator 11 through a resistor 22C.

In this instance, the ring electrode member 22B is formed, for example, by bending a narrow wire of a semiconducting material into the shape of a round ring. The resistor 22C serves to suppress an abrupt discharge of accumulated electric charge from the side of the first high voltage generator 11 in the event of an occurrence of short-circuiting between the ring electrode member 22B and the coating object A. A first high voltage V1 is applied to the ring electrode member 22B from the high voltage generator 11.

The ring electrode member 22B is mounted in coaxial relation with the rotary atomizing head 4 and in a position coinciding with a circle of a larger diameter encircling the rotational shaft 3C at the center. That is to say, the ring electrode member 22B is located at a uniform distance from the rotary atomizing head 4 at any circumference position all around the ring. Further, the ring electrode member 22B of the external electrode 22 is located in such a way as to circumvent the housing member 6 keeping a clearance (a space) of a predetermined width from the latter. Thus, as a corona discharge is brought on the ring electrode member 22B, paint particles floating in the environs of the housing member 6 are re-electrified by the external electrode 22 and at the same time the outer surface 6A of the housing member 6 is electrified by supply of corona ions from the external electrode 22.

Indicated at 23 is a secondary external electrode which is located on the front side of the housing member 6. Similarly to the primary external electrode 22 described above, the secondary external electrode 23 is constituted, for example, by three relatively short rod-like electrode support arms 23A which are extended forward from the housing member 6, and a ring electrode member 23B which is attached to fore distal ends of the respective electrode support arms 23A.

In this instance, each one of the electrode support arms 23A is formed of, for example, the same insulating synthetic resin material as the housing member 6, and located at uniform intervals in the circumferential or radial direction. On the other hand, the ring electrode member 23B is formed in the shape of a round ring, for example, by the use of a semiconducting material having a resistance of approximately 100 MΩ to 300 MΩ, and connected to a second high voltage generator 12 through a resistor 23C. The resistor 22C serves to suppress an abrupt discharge of accumulated electric charge from the side of the second high voltage generator 12 in the event of an occurrence of short-circuiting between the ring electrode member 23B and the coating object A. A second high voltage V2 is applied to the ring electrode member 23B from the second high voltage generator 12.

The ring electrode member 23B of the external electrode 23 is located in coaxial relation with the rotary atomizing head 4, in a position radially inward and axially forward of the ring electrode member 22B of the primary external electrode 22. More specifically, as compared with the ring electrode member 22B, the ring electrode 23B is located in a position coinciding with a circle of a smaller diameter encircling the rotational shaft 3C at the center. In addition, as compared with the ring electrode member 22B of the primary external electrode 22, the ring electrode member 23B is located closer to the rotary atomizing head 4 in the axial direction (forward and backward direction).

Thus, the ring electrode member 23B is located at a uniform distance from the rotary atomizing head 4 at any circumference position all around the ring, and closer to the rotary atomizing head 4 than the ring electrode member 22B of the primary external electrode 22. By an occurrence of a corona discharge on the ring electrode member 23B, the external electrode 23 mainly plays a role of electrifying a high voltage to the paint particles which are sprayed forward from the rotary atomizing head 4.

Accordingly, the second embodiment can produce substantially the same operational effects as the foregoing first embodiment. Especially in the case of the second embodiment employing, as the secondary external electrode 23, the ring electrode member 23B which is arranged to circumvent the outer peripheral side of the rotary atomizing head 4, a corona discharge can be brought about uniformly around the entire circumference of the ring electrode 23B. In addition, since the second high voltage generator 12 applies the second high voltage in the form of a pulsating voltage V2*p* consisting of intermittent high voltage pulses to the secondary external electrode 23, a corona discharge can be brought about uniformly all around the ring electrode member 23B, free of concentration of corona discharges at one particular spot in a certain locality on the ring electrode 23B.

As compared with an acicular electrode, a ring electrode which is made of a metallic material is generally larger in electrostatic capacity relative to the ground. Therefore, in the case of a conventional metallic ring electrode member, when sparks come out upon approaching abnormally close proximity to a grounded object like the coating object A, there is a tendency toward conduction of a larger discharge current to increase the possibilities of firing.

In contrast, in the case of the present embodiment employing the ring electrode members 22B and 23B of a semiconducting material, the discharge current can be minimized to a sufficient degree to suppress the possibilities of firing.

The ring electrode member 22B of the primary external electrode 22 is arranged to circumvent the circumference of the housing member 6, so that a corona discharge can be brought about all around the ring electrode member 22B. Therefore, a sufficient amount of discharge ions can be supplied to the housing member 6 for stably sustaining a high potential on the outer surface 6A of the housing member 6. Besides, by the corona discharge around the ring electrode member 22B, paint particles which are attenuated in electrification level can be re-electrified to a sufficient degree.

Figure 11:
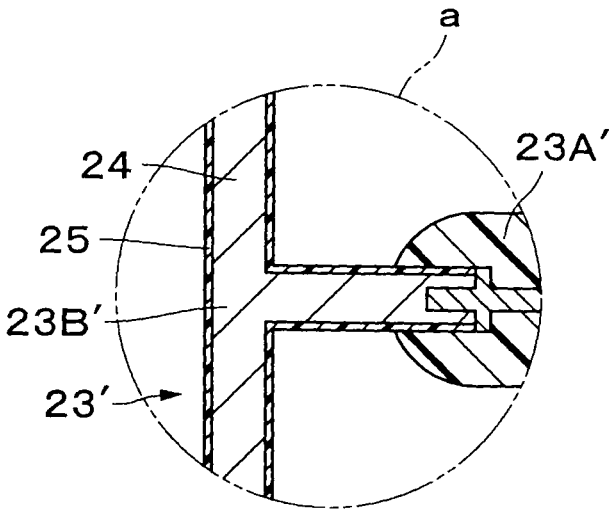
FIG. 11 is a sectional view taken from the same position as FIG. 10, showing a ring electrode member in a modification according to the invention.

Further, in the second embodiment, the ring electrode members 22B and 23B are formed of a semiconducting material. However, the present invention is not limited to this particular example. For instance, as in a modification shown in FIG. 11, a ring electrode member 23B' may be formed by the use of a metal wire 24 formed of a conducting material which is covered with an insulation coating 25. Even in this case, sparking can be prevented by the insulation coating 25.

Figure 12:
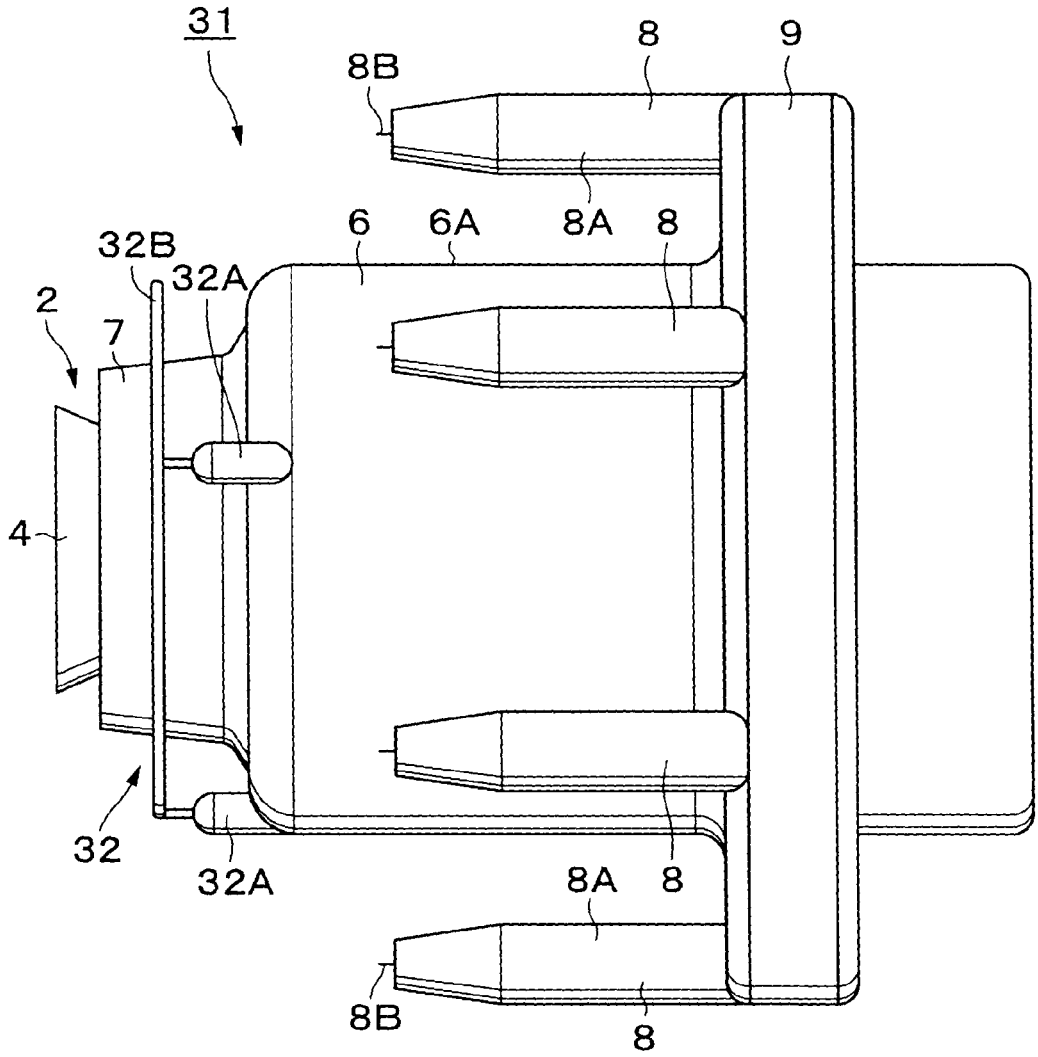
FIG. 12 is a front view of a rotary atomizing head type coating apparatus according to a third embodiment of the invention.

Now, turning to FIG. 12, there is shown a third embodiment of the rotary atomizing head type coating apparatus.

The third embodiment has a feature in that it employs a primary external electrode which is composed of a number of acicular electrode members, in combination with a secondary external electrode which is constituted by a ring electrode member. In the third embodiment, the component elements that are identical to those of the foregoing first embodiment will be simply denoted by the same reference numerals to avoid repetitions of similar explanations.

Indicated at 31 is a rotary atomizing head type coating apparatus according to the third embodiment. Substantially in the same manner as the coating apparatus 1 in the first embodiment, this coating apparatus 31 is constituted by an atomizer 2, housing member 6, primary and secondary external electrodes 8 and 32, and first and second high voltage generators 11 and 12.

Indicated at 32 is a secondary external electrode which is located on the front side of the housing member 6. Substantially in the same way as the secondary external electrode 23 in the foregoing second embodiment, the secondary external electrode 32 is composed of, for example, three short rod-like electrode support arms 32A which are projected on the front side of the housing member 6, and a ring electrode member 32B which is attached on fore distal ends of the electrode support arms 32A.

In this instance, the electrode support arms 32A are each formed, for example, by the use of the same insulating synthetic resin material as the housing member 6, and located in equidistant circumferential positions. On the other hand, the ring electrode member 32B is formed in the shape of a circular ring, for example, by the use of a semiconducting material or by the use of a conducting material covered with an insulation coating, and connected to the second high voltage generator 12 through a resistor (not shown) which is inserted for the purpose of suppressing spark discharges. A second high voltage V2 is applied to the ring electrode 32B from the high voltage generator 12.

The ring electrode member 32 of the external electrode 32 is located in coaxial relation with the rotary atomizing head 4 and in a position radially inward and axially forward of acicular electrode members 8B on a primary external electrode member 8. More specifically, the ring electrode 32B is located in a position coinciding with a circle of a small diameter encircling the rotational shaft 3C at the center and located radially inward and axially forward of the acicular electrode members 8B. In addition, the ring electrode member 32B is located closer to the rotary atomizing head 4 than the acicular electrode members 8B of the primary external electrode 8 in the axial direction (forward and backward direction).

Thus, the ring electrode member 32B is located at a uniform distance from the rotary atomizing head 4 at any circumference position of the ring, and located closer to the rotary atomizing head 4 than the acicular electrode members 8B of the primary external electrode 8. Paint particles which are sprayed forward from the rotary atomizing head 4 are charged with a high voltage by a corona discharge which is brought about all around the ring electrode member 32B of the external electrode 32.

Thus, the above-described third embodiment of the invention can produce substantially the same operational effects as the foregoing first and second embodiments. Especially in the case of the third embodiment employing the acicular electrode members 8B for the primary external electrode 8, an electric field can be concentrated at each acicular electrode member 8B so that, as compared with a ring electrode, a stronger electrostatic field can be formed between each acicular electrode member 8B and a coating object A. Under the influence of the strong electrostatic field by the acicular electrode members 8B, paint particles which have been electrified by the secondary external electrode 32 are urged in a more positive way to fly toward and deposit on the coating object A.

Figure 13:
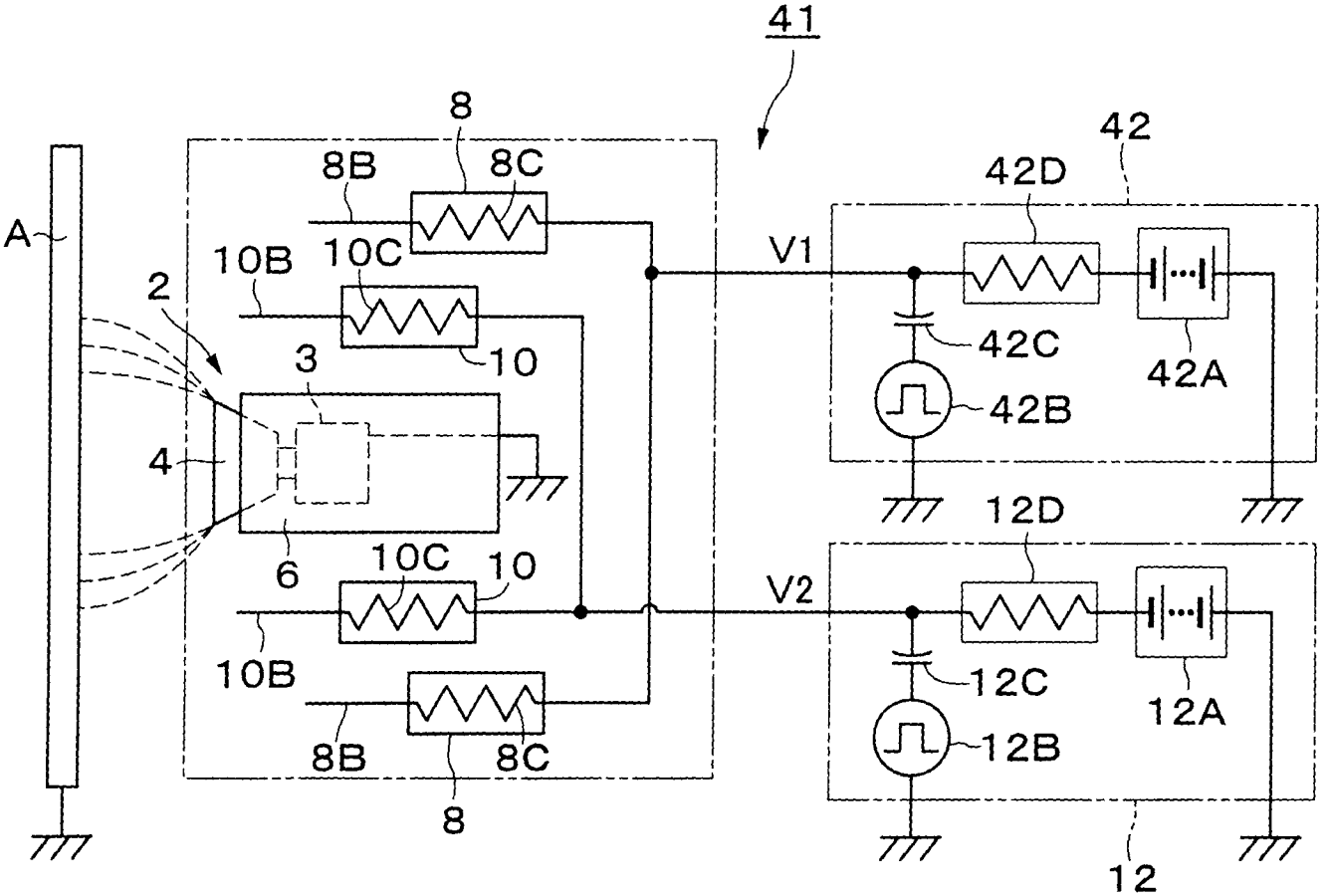
FIG. 13 is a block diagram of a circuitry adopted for a rotary atomizing head type coating apparatus according to a fourth embodiment of the invention.
Figure 14:
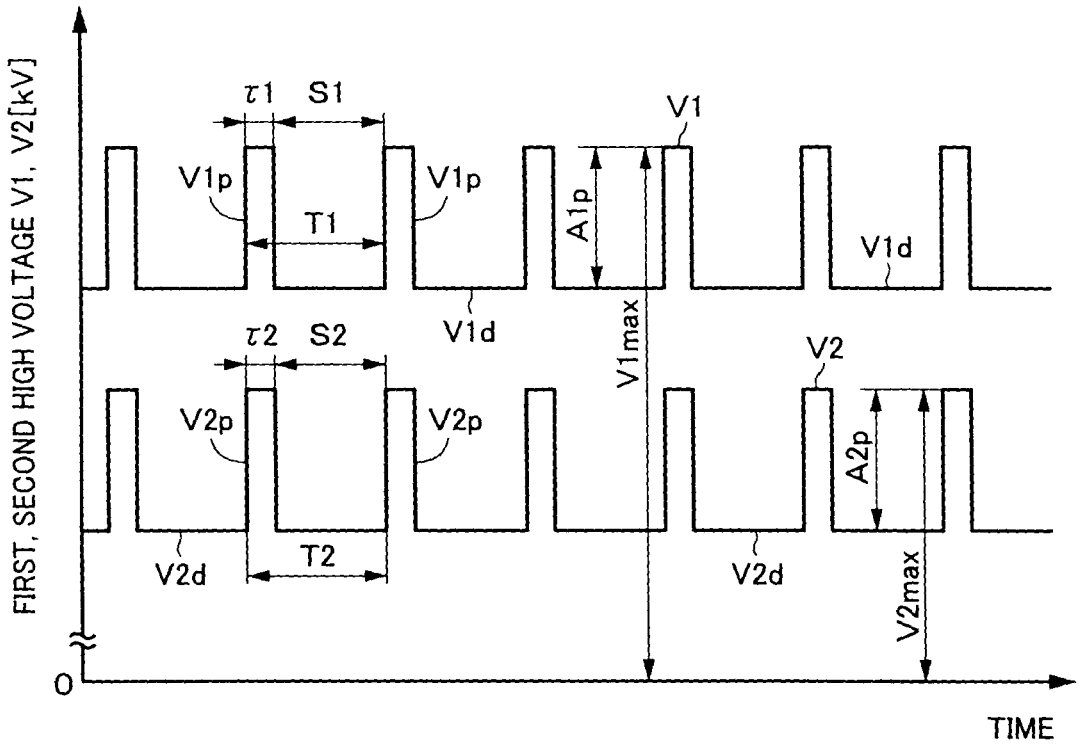
FIG. 14 is a characteristics diagram showing variations with time in first and second high voltages to be applied to primary and secondary external electrodes.

Now, turning to FIGS. 13 and 14, there is shown a rotary atomizing head type coating apparatus according to a fourth embodiment of the invention.

The fourth embodiment has a feature in that a first pulsating high voltage is supplied to a primary external electrode from a first high voltage generator, while a second pulsating high voltage is supplied to a secondary external electrode from a second high voltage generator. In the following description of the fourth embodiment, those component parts which are identical with the counterparts in the foregoing first embodiment are simply designated by the same reference numeral or character to avoid repetitions of similar explanations.

Indicated at 41 is a rotary atomizing head type coating apparatus according to the fourth embodiment of the invention. Substantially in the same way as the coating apparatus 1 in the first embodiment, the coating apparatus 41 is constituted by an atomizer 2, housing member 6, primary and secondary external electrodes 8 and 10, and first and second high voltage generators 42 and 12.

Denoted at 42 is a first high voltage generator which is connected to a primary external electrode 8 as a first high voltage application means. Similarly to the above-described second high voltage generator 12, the first high voltage generator 42 is composed of a multi-stage rectification circuit 42A, pulse generator circuit 42B, capacitor 42C and resistor 42D. The pulse generator circuit 42B is connected to the output side of the multi-stage rectification circuit 42A through the capacitor 42C and resistor 42D, and at the same time connected to the acicular electrodes 8B of the external electrode 8 between the capacitor 42C and the resistor 42D.

Further, the high voltage generator 42 is adapted to generate a pulsating voltage V1*p* consisting of a series of intermittent pulses which are in a higher voltage range as compared with the second high voltage V2. The first voltage V1 in the form of the pulsating voltage V1*p* is applied to the respective acicular electrode members 8B of the external electrode 8. More specifically, for example, the first high voltage V1 is composed of a direct-current voltage V1*d* of −30 kV to −60 kV and, for example, pulsating voltage V1*p* of −30 kV to −90 kV, each with a pulse amplitude of A1*p* as shown in FIG. 14. In this instance, the direct-current voltage V1*d* is set at a higher level than the second high voltage V2. The pulse amplitude A1*p* is set, for example, at a value which is as large as or smaller than 1.5 times the direct-current voltage V1*d*. Thus, as expressed by Formula 6 below, for example, a peak voltage V1 max (maximum voltage) of the pulsating voltage V1*p* is set in a range between −60 kV and −150 kV.

$$|V1d|>|V2|$$

$$|A1p|\leqq|V1d\times1.5|$$

$$V1\max=-60\text{ kV to }-150\text{ kV} \qquad \text{[Formula 6]}$$

The second high voltage V2 is composed of, for example, a direct-current voltage V2*d* of −10 kV to −30 kV and, for example, pulsating voltage V2*p* of −10 kV to 45 kV, each with an amplitude of A2*p*.

As expressed by Formula 7 below, pulses in the pulsed voltage V2*p* have a pulse width of it (a mesial width) which is shorter than a streamer emergence time over which a streamer comes to emerge due to an increase of electronic avalanches.

$$\tau1<\text{a streamer emergence time} \qquad \text{[Formula 7]}$$

Further, as expressed by Formula 8 below, an interval S1 between two adjacent pulses in the pulsating voltage V1*p* is set to have a longer time duration as compared with a refresh time which is taken for a weak and stable corona discharge to come out around the primary external electrode 8 (around the acicular electrode members 8B) as a result of a reduction in number of positive ions.

$$S1>\text{a refresh time} \qquad \text{[Formula 8]}$$

The direct-current voltage V1*d* is constantly applied to the primary external electrode 8 even when the pulsating voltage V1*p* is not. Therefore, the primary external electrode 8 keeps a weak corona discharge even when the pulsating voltage V1*p* is not applied thereto.

The first and second high voltage generators 42 and 12 are adapted to apply the pulsating voltages V1*p* and V2*p* which are synchronized with each other in period and phase. That is to say, the pulsating voltages V1*p* and V2*p* are applied in synchronized timing, so that a difference in potential between the acicular electrode members 8B and 10B on application of the pulsating voltages V1*p* and V2*p* can be minimized as compared with a case where the pulsating voltages V1*p* and V2*p* are applied off timing relative to each other. Accordingly, it becomes possible to prevent contamination of the external electrodes 8 and 10 which would otherwise be brought about by deposition of paint particles due to a difference in potential between the acicular electrode members 8B and 10B.

Thus, the above-described fourth embodiment can produce substantially the same operational effects as in the foregoing first embodiment. Especially in the case of the fourth embodiment employing the first high voltage generator 42 which is adapted to apply the intermittently pulsating voltage V1*p* to the primary external electrode 8 as the first high voltage V1, a higher voltage can be applied to the primary external electrode 8 as compared with a case where a direct-current voltage is applied. That is to say, a greater a quantity of discharge ions can be supplied to the outer surface 6A of the housing member 6, and at the same time paint particles afloat can be re-electrified with a higher electric charge.

In the fourth embodiment described above, acicular electrode members 8B and 10B are employed for the primary and secondary external electrodes 8 and 10 in the same way as in the foregoing first embodiment. However, if desired, a ring electrode member may be employed for both of the primary and secondary external electrodes as in the second embodiment. Alternatively, the first high voltage generator 42 of the fourth embodiment may be applied to the rotary atomizing head type coating apparatus 31 of the third embodiment.

Figure 15:
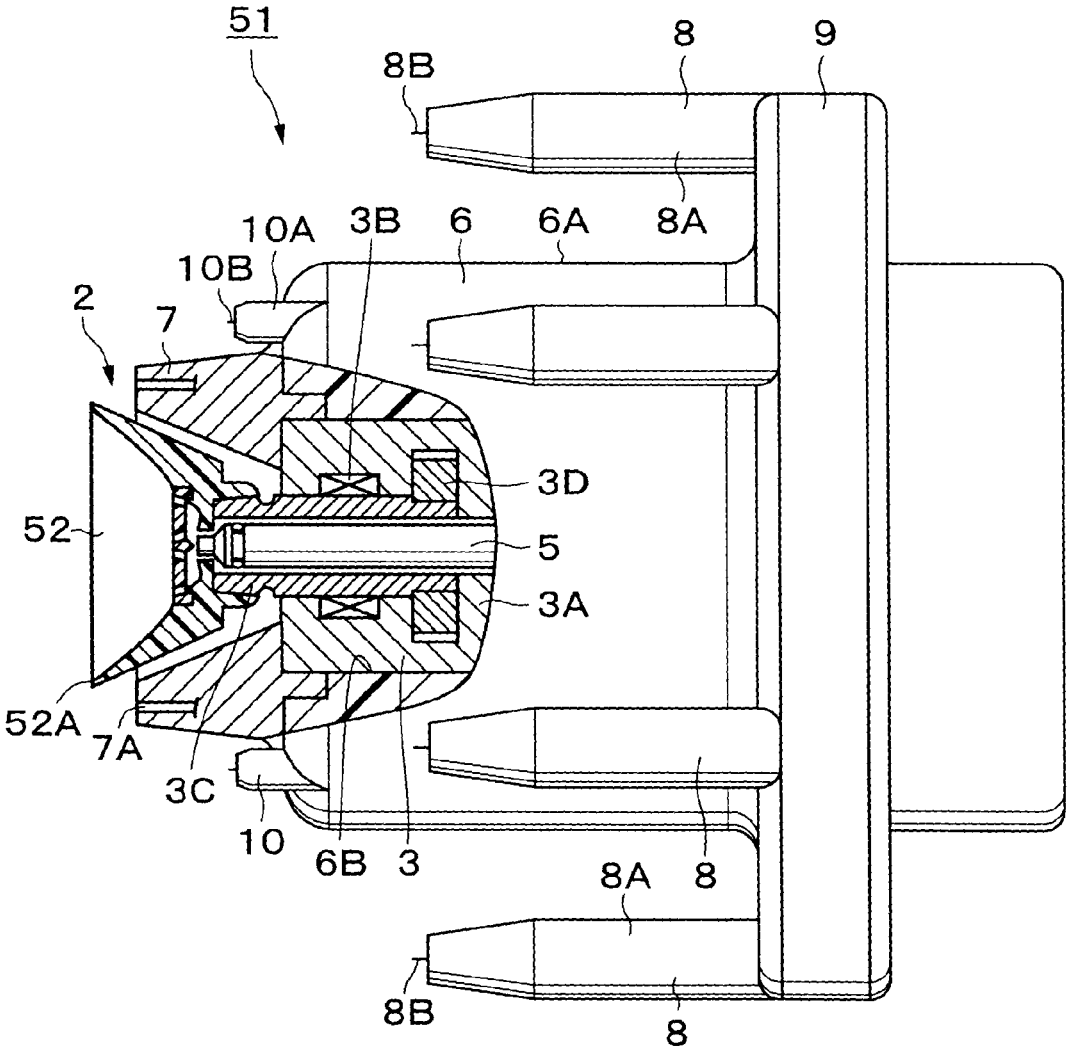
FIG. 15 is a front view of a rotary atomizing head type coating apparatus according to a fifth embodiment of the invention, taken in the same position as FIG. 2, cutting away a circumferential portion of an atomizer.

Now, turning to FIG. 15, there is shown a rotary atomizing head type coating apparatus according to a fifth embodiment of the invention.

This fifth embodiment has a feature in that a rotary atomizing head is formed of an insulating synthetic resin material. In the fifth embodiment, the component elements that are identical to those of the foregoing first embodiment will be simply denoted by the same reference numerals to avoid repetitions of similar explanations.

Indicated at 51 is a rotary atomizing head type coating apparatus according to the fifth embodiment. Substantially in the same manner as the coating apparatus 1 in the foregoing-first embodiment, this coating apparatus 51 is constituted by an atomizer 2, housing member 6, primary and secondary external electrodes 8 and 10, and first and second high voltage generators 11 and 12. However, the fifth embodiment differs from the coating apparatus 1 in the first embodiment in that the rotary atomizing head 52 of the atomizer 2 is formed of an insulating synthetic resin material.

Indicated at 52 is a rotary atomizing head adopted in the fifth embodiment. This rotary atomizing head 52 is mounted on a fore distal end portion of a rotational shaft 3C of an air motor 3. For example, the rotary atomizing head 52 is formed of an insulating synthetic resin material such as PTFE (polytetrafluoroethylene), POM (polyoxymethylene), PET (polyethylene terephthalate), PEN (polyethylene naphthalate) PP (polypropylene), HP-PE (high pressure polyethylene), HP-PVC (high pressure polyvinyl chloride), PEI (polyetherimide), PES (polyethersulfon), polymethyl pentene, PPS (polyphenylene sulfide), PEEK (polyetheretherketone), PAI (polyamideimde), PI (polyimide) and so forth.

While the rotary atomizing head 52 is being put in high-speed rotation by the air motor 3, paint is supplied to the rotary atomizing head 52 through a feed tube 5 and sprayed forward from paint releasing edges 52A at the fore distal end of the rotary atomizing head 52 under the influence of centrifugal force.

Thus, the above-described fifth embodiment can produce substantially the same operational effects as the foregoing first embodiment. Especially in the case of the fifth embodiment, the rotary atomizing head 52 which is formed of an insulating synthetic resin material can more effectively suppress sparks which might occur between the secondary external electrode 10 and rotary atomizing head 52 upon application of the second high voltage V2, as compared with a rotary atomizing head 52 formed of a conducting material. That is to say, the coating apparatus has a higher degree of freedom in design with regard to the setting of the second high voltage V2 to be applied to the secondary external electrode 10 and layout and dimensions of the secondary external electrode 10 as well, in downsizing the coating apparatus 51 as a whole and in improving maneuverability of the coating apparatus 51.

As described above, in the fifth embodiment of the invention, the rotary atomizing head 52 is formed of an insulating synthetic resin material. However, the present invention is not limited to a rotary atomizing head of that nature. For instance, the rotary atomizing head may be formed of a semiconducting synthetic resin material or an insulating synthetic resin material covered with a semiconducting surface coating. In these cases, it is possible to produce substantially the same operational effects as in the above-described fifth embodiment.

Figure 16:
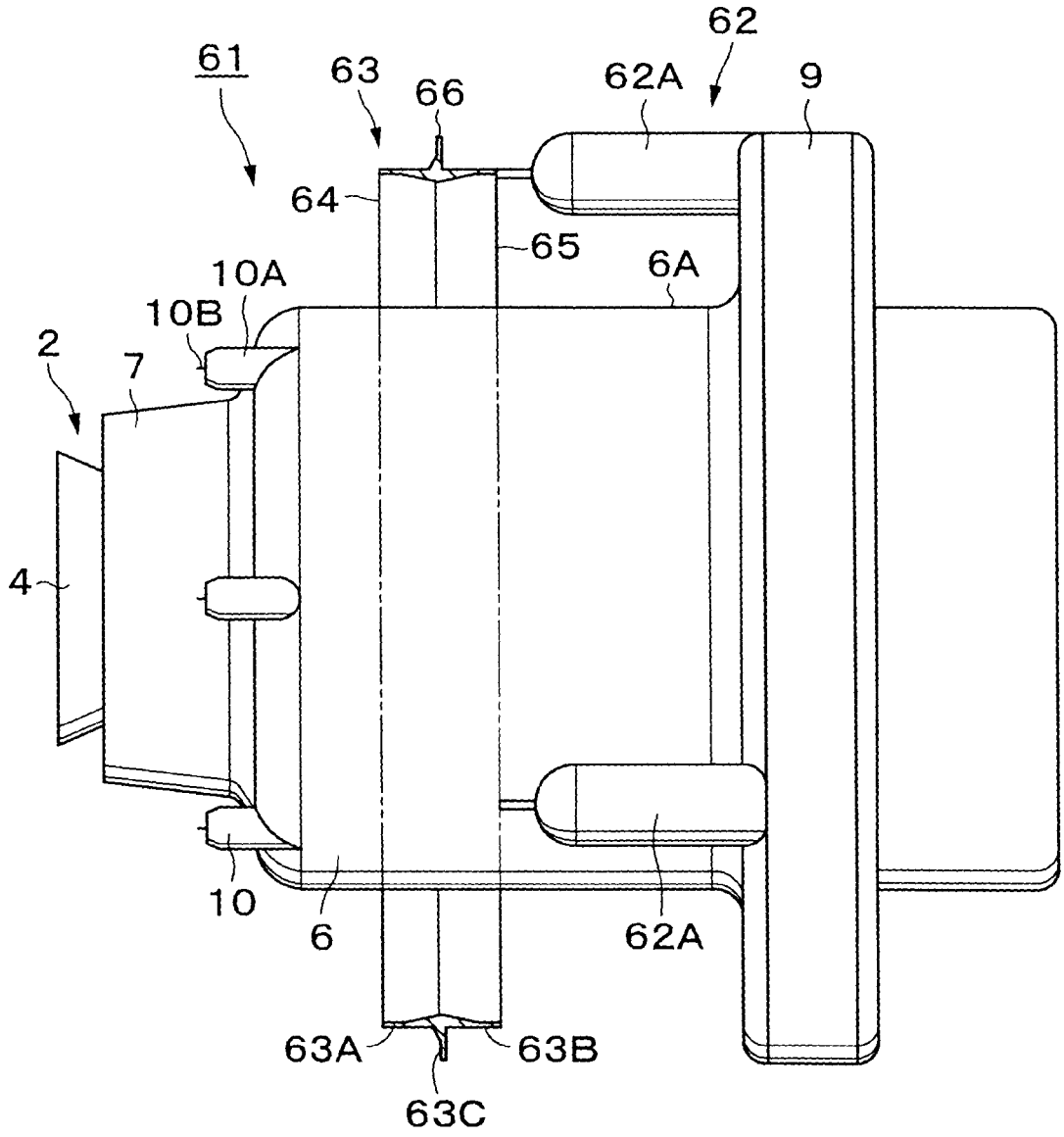
FIG. 16 is a front view of a rotary atomizing head type coating apparatus according to a sixth embodiment of the invention.
Figure 17:
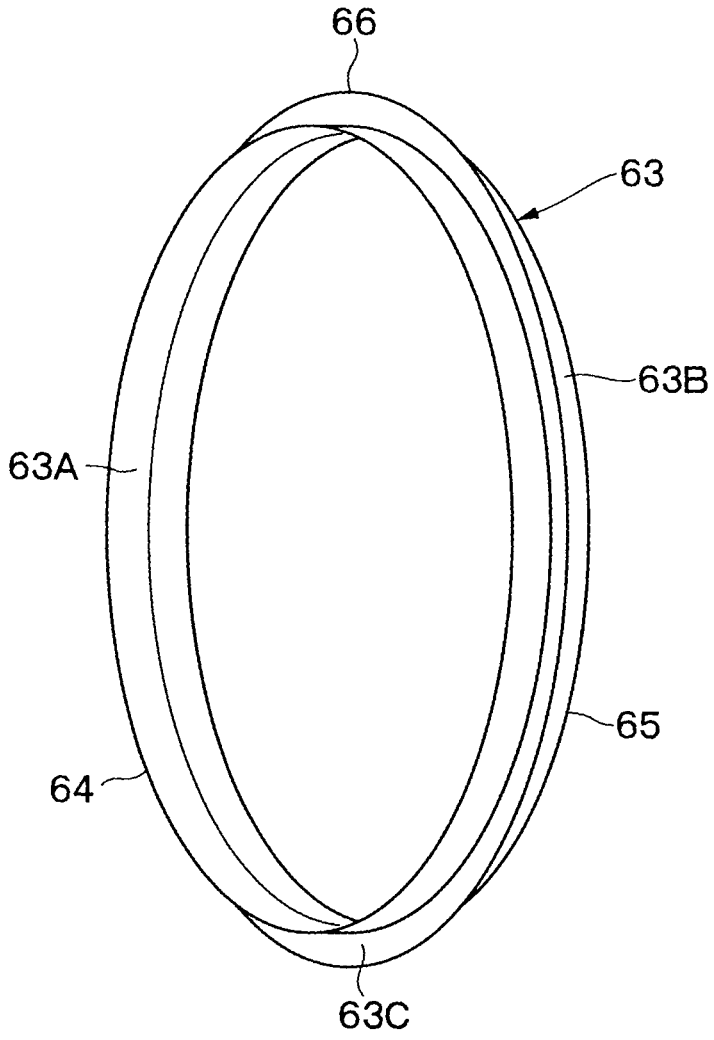
FIG. 17 is a perspective view of a blade electrode member in FIG. 16 alone.

Now, turning to FIGS. 16 and 17, there is a sixth embodiment of the rotary atomizing head type coating apparatus.

The sixth embodiment has a feature in that a blade-like electrode is employed as a primary external electrode. In the sixth embodiment, the component elements that are identical to those of the foregoing first embodiment will be simply denoted by the same reference numerals to avoid repetitions of similar explanations.

Indicated at 61 is a rotary atomizing head type coating apparatus according to the sixth embodiment. Substantially in the same way as the coating apparatus 1 in the foregoing first embodiment, the coating apparatus 61 is constituted by an atomizer 2, housing member 6, primary and secondary external electrodes 62 and 10 and first and second high voltage generators 11 and 12.

Indicated at 62 is a primary external electrode which is located around the outer peripheral side of the housing member 6. Similarly to the primary external electrode 8 in the first embodiment, this primary electrode 62 is attached to an annular support member 9 at the rear side of the housing member 6. However, the primary external electrode 62 differs from the primary external electrode 8 of the first embodiment in that it employs a bladed electrode member 63 instead of the acicular electrode member 8B.

In this instance, the external electrode 62 is composed of a number of long rod-like electrode support arms 62A, for example, three electrode support arms 62A which are extended forward from an annular support member 9, and a bladed electrode member 63 which is attached on fore distal ends of the electrode support arms 62A. Here, for example, the three electrode support arms 62A are formed of the same insulating synthetic resin material as the housing member 6 and located in equidistant circumferential positions.

Further, the bladed electrode member 63 is located in coaxial relation with the rotary atomizing head 4, in a position coinciding with a circle having a larger radius which is located around the rotational shaft 3C at the center. Further, the bladed electrode member 63 is spaced from the housing member 6 by a clearance (space), and located in such a way as to circumvent the outer peripheral side of the housing member 6. Thus, the bladed electrode member 63 is disposed to keep a uniform distance from the rotary atomizing head 4 and housing member 6 at any radial position.

Further, the bladed electrode member 63 is formed substantially in an annular shape by the use of, for example, a conducting material like a metal or a semiconducting material. In this instance, the bladed electrode member 63 is composed of front and rear blade rings 63A and 63B which are projected axially in forward and rearward directions, respectively, along with a radial blade ring 63C which is projected in a radially outward direction.

The bladed electrode member 63 is connected to a first high voltage generator 11 through a resistor (not shown). Thus, from the high voltage generator 11, a first high voltage V1 is applied to the bladed electrode member 63 to form an electrostatic field between the bladed electrode member 63 and a coating object A which is at the earth potential.

Denoted at 64, 65 and 66 are edge sections which are provided at distal ends of the front blade ring 63A, rear blade ring 63B and radial blade ring 63C of the bladed electrode member 63, respectively. In this instance, the thickness of the front edge section 64 of the front blade ring 63A is gradually thinned down in a forward direction to present a shape of a thin blade. Similarly, the thickness of the rear edge section 65 of the rear blade ring 63B is gradually thinned down in a rearward direction to present a shape of a thin blade. Further, the thickness of the radial edge section 66 of the radial blade ring 63C is gradually thinned down in a radially outward direction to present a shape of a thin blade.

Each one of the edge sections 64, 65 and 66 functions to enhance an electric field all around the bladed electrode member 63. For example, when a high voltage of 90 kV is applied, a discharge current of approximately 20 μA to 100 μA occurs at the edge sections 64, 65 and 66 to bring about a stable corona discharge. As a consequence, by the corona discharges which are brought on the bladed electrode member 63 of the external electrode 62, paint particles in float around the housing member 6 are re-electrified with a high voltage, and at the same time corona ions are supplied to the outer surface 6A of the housing member 6 to impart an electric charge to the housing member 6.

Thus, the above-described sixth embodiment of the invention can also produce substantially the same operational effects as the foregoing first embodiment. Especially in the case of the sixth embodiment employing the bladed electrode member 63 for the primary external electrode 62, an electric field can be concentrated at the edge sections 64, 65 and 66 of the bladed electrode member 63 to bring about corona discharges all around the bladed electrode member 63. Thus, a sufficient quantity of discharge ions can be supplied to the housing member 6 to sustain the outer surface 6A of the housing member 6 at a high potential in a stable state. In addition, paint particles which are attenuated in electrification level can be re-electrified by corona discharges on the edge sections 64, 65 and 66 of the bladed electrode member 63.

Further, the bladed electrode member 63 is capable of producing a corona discharge all along the respective annular edge sections 64, 65 and 66 which are arranged in such a way as to circumvent the housing member 6. This means that the bladed electrode member 63 can be downsized as compared with an electrode which is arranged to produce a corona discharge only in a certain locality or localities, permitting to keep the bladed electrode member 63 at a sufficient distance from a coating object A. Consequently, it becomes possible to prevent occurrence of spark discharges between the bladed electrode member 63 and the coating object A, and to broaden a movable range of the coating apparatus 61 for the purpose of improving its maneuverability when put in operation in a narrow space.

Figure 18:
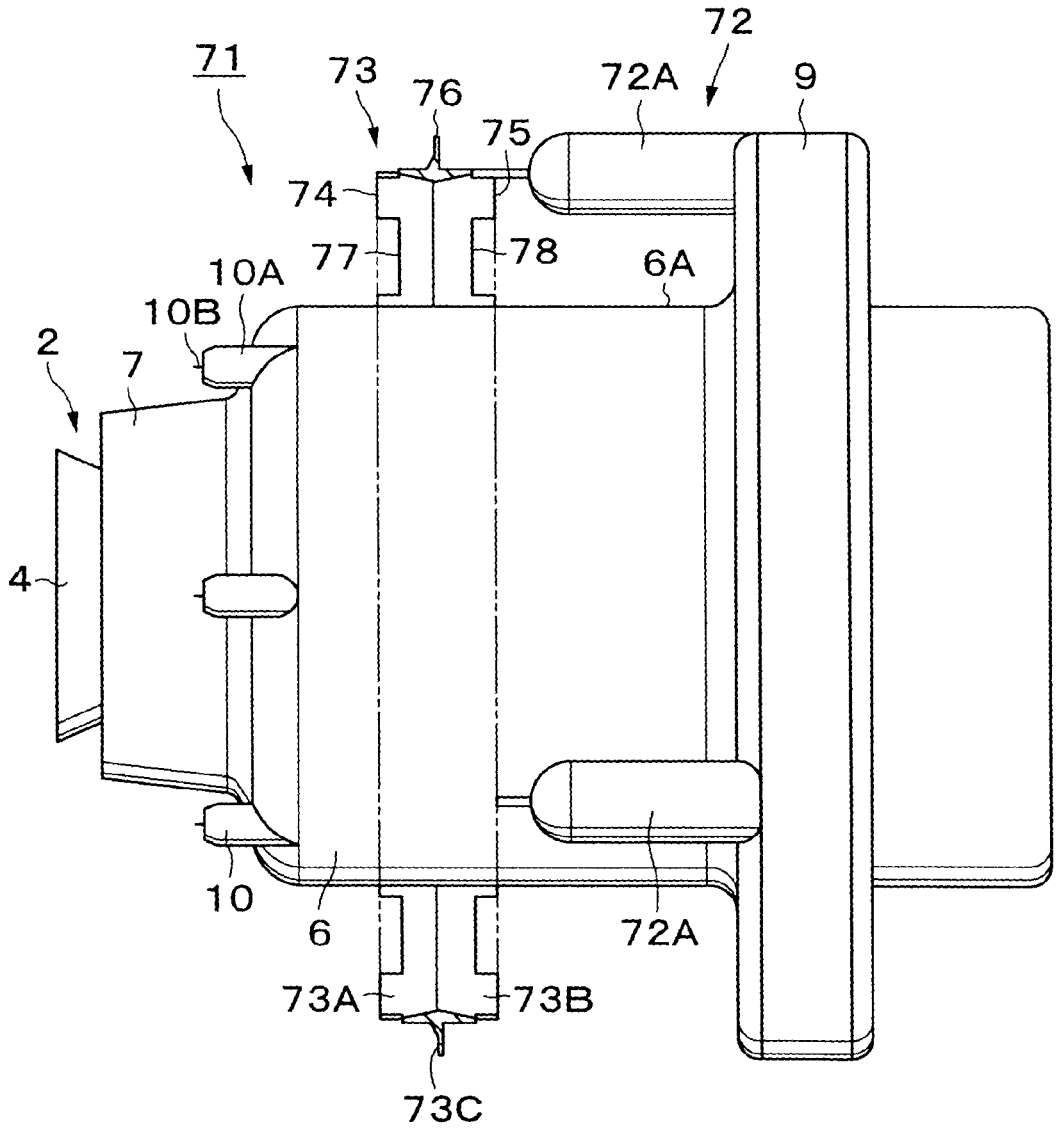
FIG. 18 is a front view of a rotary atomizing head type coating apparatus according to a seventh embodiment of the invention.
Figure 19:
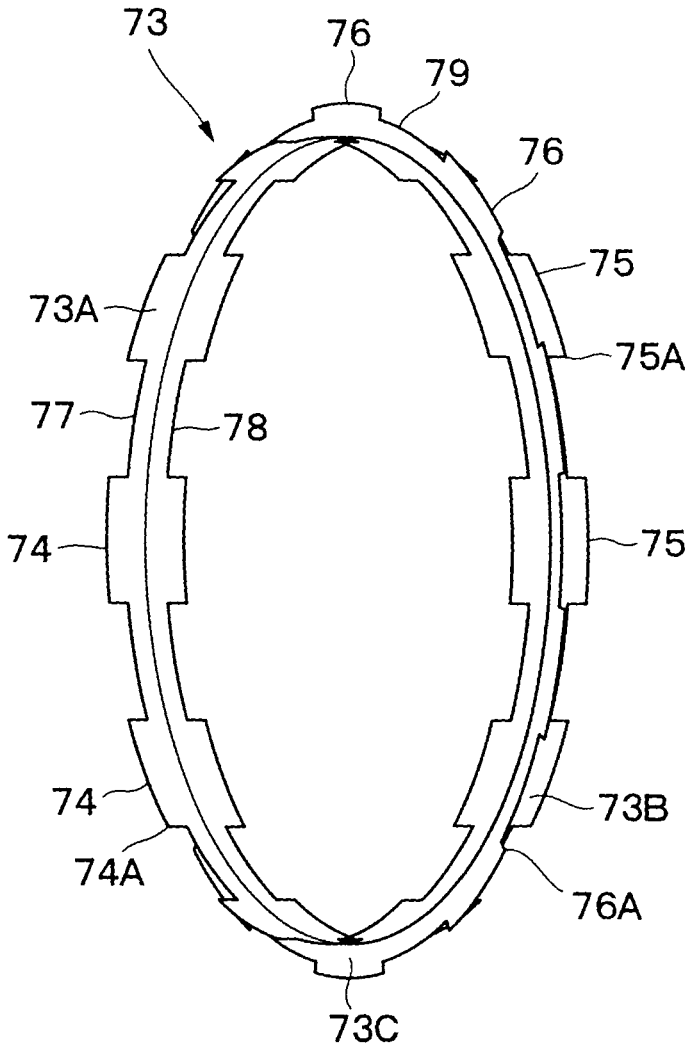
FIG. 19 is a perspective view of a blade electrode member in FIG. 18 alone.

Now, turning to FIGS. 18 and 19, there is shown a rotary atomizing head type coating apparatus according to a seventh embodiment of the present invention.

This seventh embodiment has a feature in that it employs a bladed electrode member as a primary external electrode, having a plural number of notches along each one of edge sections of the electrode member. In the seventh embodiment, the component elements that are identical to those of the foregoing first embodiment will be simply denoted by the same reference numerals to avoid repetitions of similar explanations.

Indicated at 71 is a rotary atomizing head type coating apparatus according to the seventh embodiment. Substantially in the same way as the coating apparatus 1 in the foregoing first embodiment, the coating apparatus 71 is composed of an atomizer 2, housing member 6, primary and secondary external electrodes 72 and 10, and first and second high voltage generators 11 and 12.

Denoted at 72 is a primary external electrode which is located on the outer peripheral side of the housing member 6. Substantially in the same way as the primary electrode 8 in the first embodiment, the primary electrode 72 is mounted on an annular support member 9 at the rear of the housing member 6. In this instance, similarly to the external electrode 62 in the sixth embodiment, the primary external electrode 72 is constituted by a bladed electrode member 73.

More specifically, the external electrode 72 is composed of, for example, three long rod-like electrode support arms 72A which are extended forward from the support member 9, and a bladed electrode member 73 which is attached on fore distal ends of the electrode support arms 72A. In this instance, for example, the three electrode support arms 72A are formed by the use of the same insulating synthetic resin material as the housing member 6, and located equidistant circumferential positions around the housing member 6.

The bladed electrode member 73 is located in coaxial relation with the rotary atomizing head 4, in a position coinciding with a circle of a larger diameter drawn around a rotational shaft 3C at the center. Further, the bladed electrode member 73 is spaced from the housing member 6 by a clearance (a space) and so disposed as to circumvent the outer peripheral side of the housing member 6. Thus, the bladed electrode member 73 is uniformly spaced from the rotary atomizing head 4 and housing member 6 at any circumference position.

The bladed electrode member 73 is formed substantially in an annular shape by the use of a conducting material like a metal or a semiconducting material. In this instance, the bladed electrode member 73 is composed of fore and rear blade rings 73A and 73B which are projected in forward and rearward directions, respectively, and a radial blade ring 73C which is projected in a radially outward direction.

The bladed electrode member 73 is connected to a first high voltage generator 11 through a resistor (not shown). Thus, a first high voltage V1 is applied to the bladed electrode member 73 from the first high voltage generator 11 to form an electrostatic field between the bladed electrode member 73 and a coating object A which is at the earth potential.

Indicated at 74, 75 and 76 are edge sections which are provided at projected ends of the front, rear and radial blade rings 73A, 73B and 73C of the bladed electrode member 73, respectively.

In this instance, each one of front edge sections 74 is formed in the shape of a sharp-edged thin blade by gradually thinning down the fore blade ring 73A in a forward direction. A plural number of front edge sections 74 (e.g., 10 front edge sections 74) are formed alternately with notches 77. Similarly, 10 rear edge sections 75 each in the shape of a sharp-edged thin blade are formed by gradually thinning down the rear blade ring 73B in a rearward direction. Further, 10 radial edge sections 76 each in the shape of a sharp-edged thin blade are formed by gradually thinning down the radial blade ring 73C in a radially outward direction.

Each one of the edge sections 74, 75 and 76 functions to enhance an electric field all around the bladed electrode member 73. When a high voltage of 90 Kv is applied, for example, conduction of a discharge current of approximately 20 μA to 100 μA takes place at the edge sections 74, 75 and 76 to produce a corona discharge in a stabilized state.

Indicated at 77, 78 and 79 are a plural number of notches which are formed in the edge sections 74, 75 and 76 at intervals in the circumferential direction of the bladed electrode member 73, respectively. For example, 10 notches 77 to 79 are formed respectively at uniform intervals in the circumferential direction of the bladed electrode member 73.

In this instance, each one of the notches 77 is formed in an arcuate shape and extended in a circumferential direction along the front edge sections 74. Further, a plural number of notches 77 (e.g., 10 notches) are formed at uniform intervals in the circumferential direction between adjacent front edge sections 74. These notches 77 contribute to concentrate an electric field at the opposite end portions 74A of each edge section 74 to accelerate the discharge.

Similarly, for example, 10 notches 78 of an arcuate shape are formed at uniform intervals between adjacent edges section 75 to concentrate an electric field at the opposite end portions 75A. Further, 10 notches 79 of an arcuate shape are formed at uniform intervals between adjacent edge section 76 to concentrate an electric field at the opposite end portions 76A.

Thus, the above-described seventh embodiment can produce substantially the same operational effects as the foregoing first embodiment. Especially in the case of the seventh embodiment employing a bladed electrode member 73 having a plural number of notches 77 to 79 alternately with edge sections 74 to 76, the electrode member 73 functions to encourage concentration of an electric field at the opposite ends of the respective end portions 74A to 76A, letting electric discharges take place more readily at the end portions 74A to 76A to accelerate corona discharges at the edge sections 74 to 76.

Figure 20:
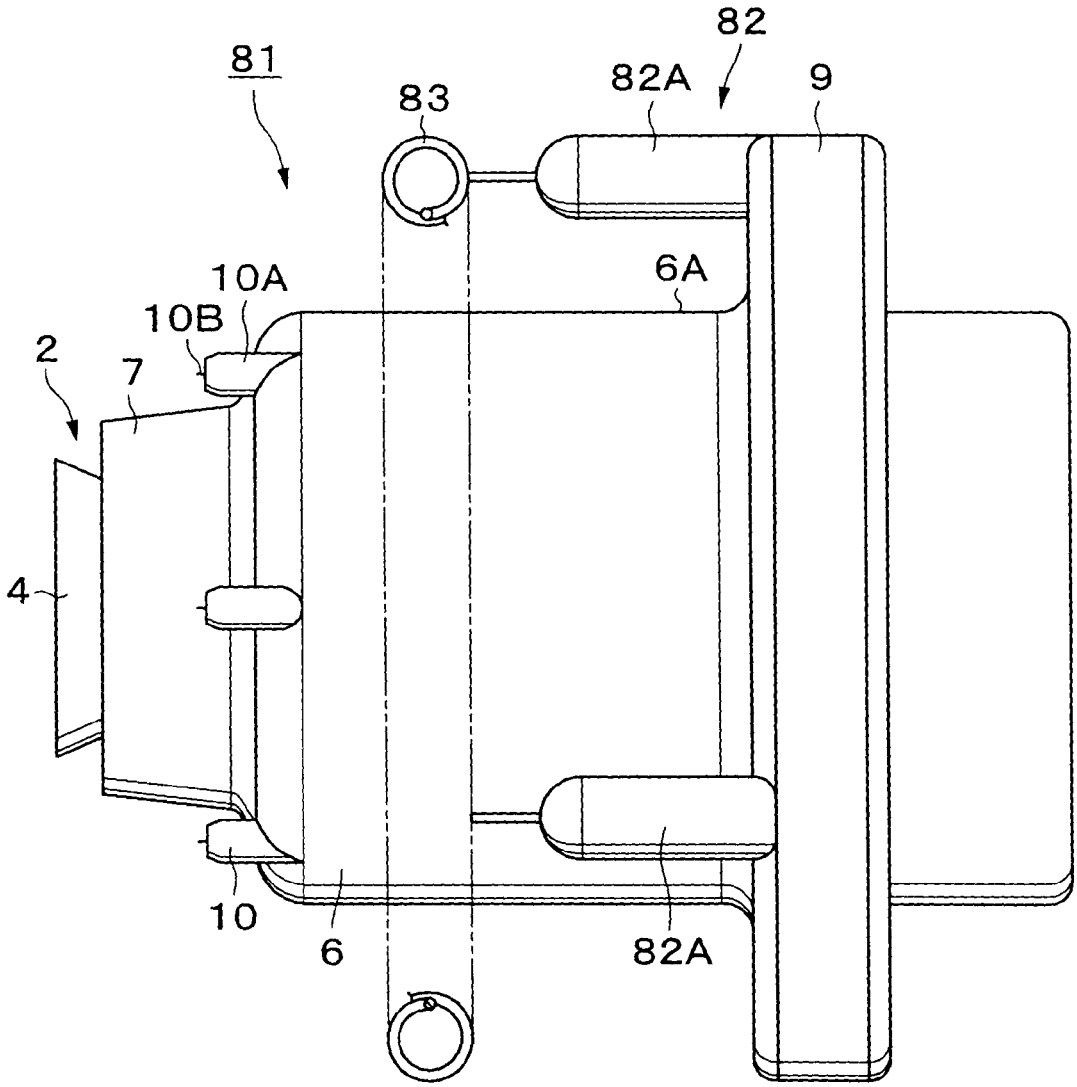
FIG. 20 is a front view of a rotary atomizing head type coating apparatus according to an eighth embodiment of the invention.
Figure 21:
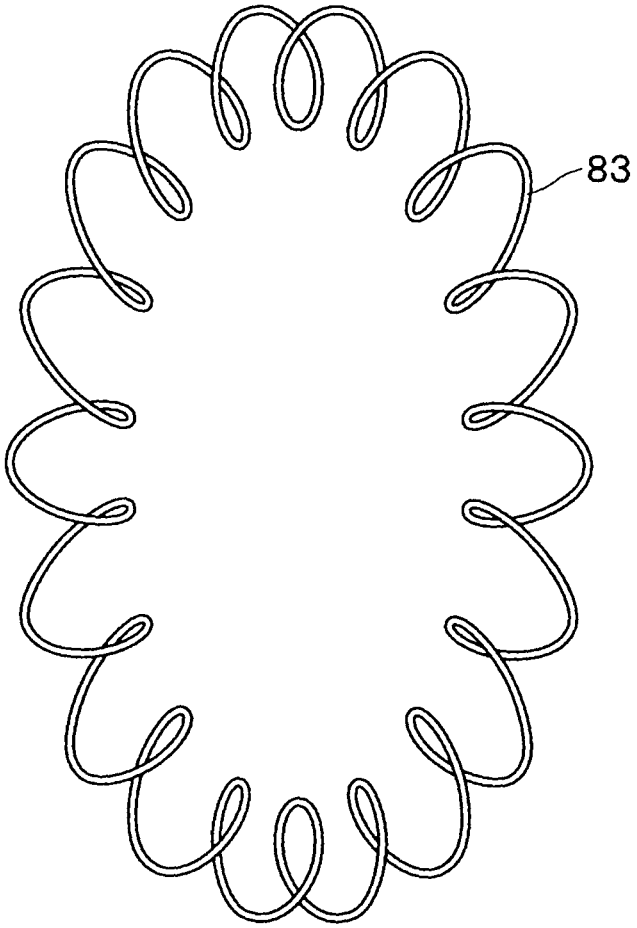
FIG. 21 is a perspective view of a helical electrode member in FIG. 20 alone.

Now, turning to FIGS. 20 and 21, there is shown a rotary atomizing head type coating apparatus according to an eighth embodiment of the present invention.

The eighth embodiment of the invention has a feature in that a primary external electrode is constituted by a helical electrode member employing a helically wound wire as an electrode. In the following description of the eighth embodiment, those component parts which are identical with the counterparts in the foregoing first embodiment are simply designated by the same reference numeral or character to avoid repetitions of similar explanations.

Indicated at 81 is a rotary atomizing head type coating apparatus according to the eighth embodiment. Substantially in the same way as in the foregoing first embodiment, the coating apparatus 81 is composed of an atomizer 2, housing member 6, primary and secondary external electrodes 82 and 10, and first and second high voltage generators 11 and 12.

Denoted at 82 is a primary external electrode which is located on the outer peripheral side of a housing member 6. Substantially in the same way as the primary external electrode 8 in the first embodiment, this primary external electrode 82 is mounted on an annular support member 9 at the rear of the housing member 6. However, the primary external electrode 82 differs from the primary external electrode 8 in the first embodiment in that it employs a helical electrode member 83 in place of acicular electrode members 8B.

The primary external electrode 82 is composed of, for example, three long rod-like electrode support arms 82A which are extended forward from the support member 9, and a helical electrode member 83 which is supported on fore distal ends of the electrode support arms 82A. In this instance, for example, three electrode support arms 82A are formed of the same insulating synthetic resin material as the housing member 6 and located in uniformly spaced radial positions around the housing member 6.

Further, the helical electrode member 83 is formed of, for example, a wire of a conducting material like a metal or a semiconducting material. The helical electrode member 83 is formed in the shape of a ring as a whole, for example, by helically winding a wire for 18 times. In this instance, for example, the helical electrode member 83 employs a wire of 0.3 mm to 5 mm in diameter in capability to create a discharge starting electric field and shape retainability of the electrode member. The length of each turn pitch of the helical ring 83 is spaced away from each other enough as compared with the breadth of corona clouds, for example, by a space broader than 20 mm.

The helical electrode member 83 is set apart from the housing member 6 by a clearance (space) and mounted in such a way as to circumvent the housing member 6. Further, the helical electrode member 83 is connected to a first high voltage generator 11 through a resistor (not shown). That is to say, a first high voltage V1 is applied to the helical electrode member 83 from the first high voltage generator 11 to form an electrostatic field between the helical electrode member 83 and a coating object A which is at the earth potential.

Thus, the above-described eighth embodiment can produce substantially the same operational effects as in the foregoing first embodiment. Especially in the case of the eighth embodiment employing as a primary external electrode 82 the helical electrode member 83 with a wire wound into a series of helices to encircle the housing member 6 in the circumferential direction. Therefore, it is possible to minimize the outer shape of the primary external electrode 82 despite the use of a wire which is increased in total length for the helical electrode member 83. That is to say, a corona discharge can be brought about on and along the entire length of an elongated wire, making it possible to increase the quantity of discharge ions by the use of the primary external electrode 82 which is compact in outer configuration.

In the fifth embodiment described above, the primary and secondary external electrodes 8 and 10 are formed by the use of the acicular electrode members 8B and 10B in the same manner as in the foregoing first embodiment. However, if desired, the primary and secondary external electrodes may be formed by the use of ring electrodes as in the second embodiment. Further, if desired, the rotary atomizing head 52 in the fifth embodiment may be similarly applied to the rotary atomizing head type coating apparatuses 31, 41, 61, 71 and 81 of the third, fourth, sixth, seventh and eighth embodiments, respectively.

Further, in the sixth and seventh embodiments described above, the bladed electrode members 63 and 73 are provided with edge sections 64, 65, 66, 74, 75 and 76 on the front, rear and radial directions, namely, three directions in total. However, the present invention is not limited to this particular example. For instance, the edge sections may be provided only on one or two of the front, rear and radial bladed electrode members if desired.

Further, in the sixth to eighth embodiments described above, the secondary external electrode 10 is formed by the use of the acicular electrode members 10B in the same manner as in the first embodiment. However, if desired, the secondary external electrode may be formed by the use of a ring electrode member as in the second embodiment. The primary external electrodes 62, 72 and 82 in the sixth to eighth embodiments may be applied to the rotary atomizing head type coating apparatus 41 of the fourth embodiment if desired.

Furthermore, in the first, third, fourth and sixth to eighth embodiments described above, the primary and secondary external electrodes 8 and 10 are composed of six acicular electrode members 8B or 10B. Needless to say, the present invention is not limited to this particular example. For instance, if desired, each one of the primary and secondary external electrodes may be composed of less than 5 or more than 7 acicular electrode members.

The invention claimed is:

1. An electrostatic coating apparatus comprising:

a paint sprayer having a rotary atomizing head on a front end side thereof for spraying a paint which is supplied to said rotary atomizing head toward a coating object, a housing member formed of an insulating material and adapted to hold said paint sprayer at a front side thereof, a primary external electrode located at an outer peripheral side of said housing member, a secondary external electrode located closer to said rotary atomizing head than is said primary external electrode, a first high voltage source electrically connected to said primary external electrode for applying a first high voltage to said primary external electrode, and a second high voltage source electrically connected to said secondary external electrode for applying a second high voltage to said secondary external electrode, wherein said second high voltage source includes a pulse generator circuit configured to provide said second high voltage to said secondary external electrode as a pulsating voltage which varies intermittently in a range whose maximum value is lower than said first high voltage.

2. An electrostatic coating apparatus as defined in claim 1, wherein said secondary high voltage source is configured to set a width of said pulsating voltage to a shorter time than a streamer emergence time over which a streamer comes to emerge as a result of an increase of electronic avalanches, and to set an interval between said pulsating voltages to a longer time than a refresh time over which a weak and stable corona discharge comes to emerge around said secondary external electrode as a result of a decrease of positive ions.

3. An electrostatic coating apparatus as defined in claim 1, wherein said secondary external electrode comprises an acicular electrode member having a fore distal end thereof located around a circumference of said rotary atomizing head.

4. An electrostatic coating apparatus as defined in claim 1, wherein said secondary external electrode comprises a ring electrode member encircling the outer peripheral side of said rotary atomizing head.

5. An electrostatic coating apparatus as defined in claim 4, wherein said ring electrode member comprises a semiconducting material or a conducting material whose surface is coated with an insulating material.

6. An electrostatic coating apparatus as defined in claim 1, wherein said primary external electrode comprises an acicular electrode member whose fore distal end is located at a more distant position from said rotary atomizing head than is said secondary external electrode.

7. An electrostatic coating apparatus as defined in claim 1, wherein said primary external electrode comprises a ring electrode member encircling the outer peripheral side of said housing member at a more distant position from said rotary atomizing head than does said secondary external electrode.

8. An electrostatic coating apparatus as defined in claim 1, wherein said primary external electrode comprises a bladed electrode member encircling the outer peripheral side of said housing member at a more distant position from said rotary atomizing head than does said secondary external electrode, and provided with edge sections in the form of a thin blade around an entire periphery of a blade ring.

9. An electrostatic coating apparatus as defined in claim 8, wherein said edge sections of said bladed electrode member are provided with a plural number of notches at intervals around the entire periphery thereof.

10. An electrostatic coating apparatus as defined in claim 1, wherein said primary external electrode comprises a helical electrode member formed by helically winding a wire and encircling the outer peripheral side of said housing member at a more distant position from said rotary atomizing head than does said secondary external electrode.

11. An electrostatic coating apparatus as defined in claim 1, wherein said first high voltage applies to said primary external electrode a pulsating voltage which varies intermittently.

12. An electrostatic coating apparatus as defined in claim 1, wherein said rotary atomizing head is formed of an insulating synthetic resin material, semiconducting synthetic resin material or insulating synthetic resin material coated with a semiconducting surface coating.

* * * * *